US010994536B2

(12) United States Patent
Arakane et al.

(10) Patent No.: US 10,994,536 B2
(45) Date of Patent: May 4, 2021

(54) IMAGE RECORDING APPARATUS

(71) Applicant: Brother Kogyo Kabushiki Kaisha, Nagoya (JP)

(72) Inventors: Satoru Arakane, Nagoya (JP); Tomohiro Nodsu, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/524,765

(22) Filed: Jul. 29, 2019

(65) Prior Publication Data

US 2020/0039216 A1 Feb. 6, 2020

(30) Foreign Application Priority Data

Jul. 31, 2018 (JP) ..... JP2018-144104

(51) Int. Cl.

| | |
|---|---|
| ***B41J 2/045*** | (2006.01) |
| ***B41J 2/14*** | (2006.01) |
| ***B41J 2/35*** | (2006.01) |
| ***B41J 2/355*** | (2006.01) |
| *B41J 2/165* | (2006.01) |

(52) U.S. Cl.

CPC ..... *B41J 2/04596* (2013.01); *B41J 2/0454* (2013.01); *B41J 2/14201* (2013.01); *B41J 2/3558* (2013.01); *B41J 2002/14403* (2013.01); *B41J 2002/16597* (2013.01)

(58) Field of Classification Search

CPC .. B41J 2/04596; B41J 2/0454; B41J 2/14201; B41J 2/3558

See application file for complete search history.

(56) References Cited

U.S. PATENT DOCUMENTS

| | | | | |
|---|---|---|---|---|
| 7,219,972 | B2 | 5/2007 | Kanematsu et al. | |
| 8,657,401 | B2 | 2/2014 | Tobita et al. | |
| 2005/0195230 | A1 | 9/2005 | Kanematsu et al. | |
| 2006/0250667 | A1* | 11/2006 | Loyer | B41J 2/1752 358/502 |
| 2012/0287186 | A1* | 11/2012 | Tanaka | B41J 2/04588 347/10 |
| 2013/0070010 | A1 | 3/2013 | Tobita et al. | |

(Continued)

FOREIGN PATENT DOCUMENTS

| | | | |
|---|---|---|---|
| JP | 2005-246641 | A | 9/2005 |
| JP | 2010-221641 | A | 10/2010 |

(Continued)

*Primary Examiner* — Jason S Uhlenhake
(74) *Attorney, Agent, or Firm* — Banner & Witcoff, Ltd.

(57) ABSTRACT

There is provided an image recording apparatus including: a head; a driving element; a controller configured to output, to the driving element, a driving signal having a first voltage level or a second voltage level greater than the first voltage level; and a moving mechanism causing one of the recording medium and the head to move relative to the other of the recording medium and the head. The controller sets the voltage level of the driving signal to be the first voltage level in a case that the controller causes the head to move relative to the recording medium at the first velocity; and the controller sets the voltage level of the driving signal to be the second voltage level in a case that the controller causes the head to move relative to the recording medium at the second velocity.

14 Claims, 12 Drawing Sheets

(56) References Cited

U.S. PATENT DOCUMENTS

| | | | | |
|---|---|---|---|---|
| 2015/0239255 | A1* | 8/2015 | Tsukida | B41J 2/17553 347/7 |
| 2017/0232746 | A1 | 8/2017 | Nishida | |

FOREIGN PATENT DOCUMENTS

| | | | |
|---|---|---|---|
| JP | 2013-063525 | A | 4/2013 |
| JP | 2017-144726 | A | 8/2017 |

* cited by examiner

Fig. 4A NON-DISCHARGE SIGNAL
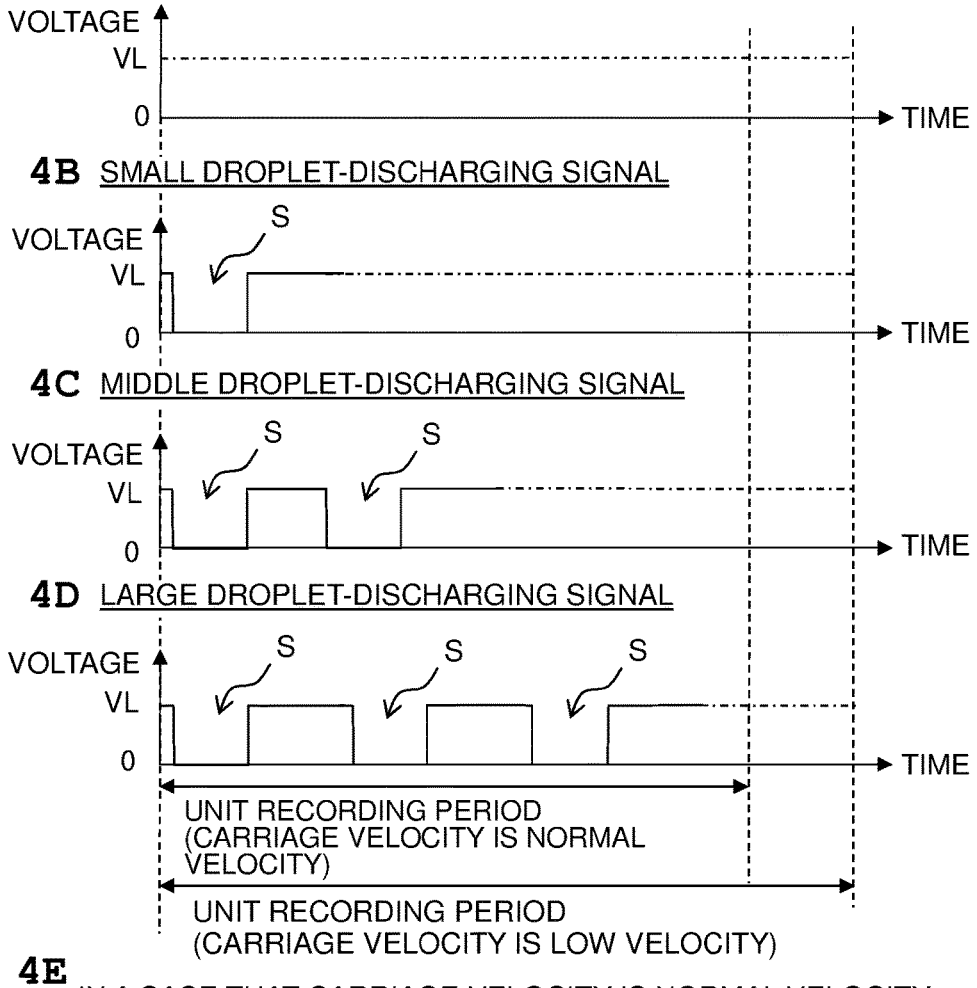
Fig. 4E IN A CASE THAT CARRIAGE VELOCITY IS NORMAL VELOCITY
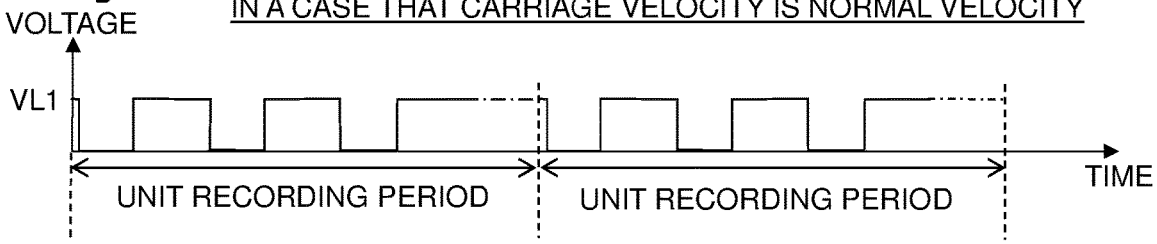
Fig. 4F IN A CASE THAT CARRIAGE VELOCITY IS LOW VELOCITY
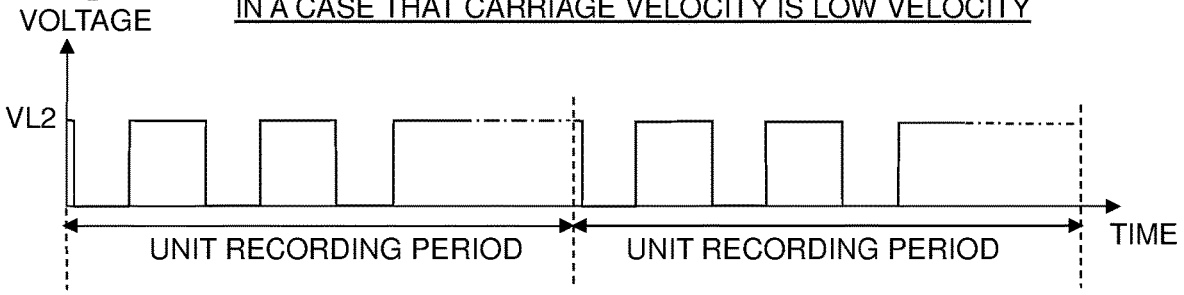

IMAGE RECORDING APPARATUS

CROSS REFERENCE TO RELATED APPLICATION

The present application claims priority from Japanese Patent Application No. 2018-144104, filed on Jul. 31, 2018, the disclosure of which is incorporated herein by reference in its entirety.

BACKGROUND

Field of the Invention

The present disclosure relates to an image recording apparatus.

Description of the Related Art

As an example of an image recording apparatus, there is a publicly known printer of the serial system which records an image on a paper by discharging an ink from nozzles of a head onto the paper sheet while moving a carriage to which the head is attached in a scanning direction. The head of this printer is provided with an ink channel (internal channel) including a nozzle and a pressure chamber to which the ink as a liquid is supplied from an ink cartridge (liquid tank), and a piezoelectric actuator. The piezoelectric actuator includes a piezoelectric layer, an individual electrode and a common electrode which are arranged to sandwich the piezoelectric layer therebetween, and is configured to apply pressure to the ink inside the pressure chamber in a case that a predetermined driving pulse (driving signal) is applied to the individual electrode, thereby discharging the ink from the nozzle. The piezoelectric layer, the individual electrode and the common electrode function as a piezoelectric element (driving element) which applies the pressure to the ink inside the pressure chamber and to cause the ink to be discharged from the nozzle. Further, there is also a publicly known printer which is configured such that the moving velocity of the carriage is variable.

SUMMARY

An object of the present disclosure is to provide an image recording apparatus capable of suppressing any degradation in the quality of an image recorded on a recording medium.

According to an aspect of the present disclosure, there is provided an image recording apparatus including: a head to which a liquid is supplied from a liquid tank via a supply path, the head including an internal channel having a nozzle, and a driving element configured to impart, to the liquid in the internal channel, discharge energy for discharging the liquid from the nozzle; a moving mechanism configured to move, in a relative moving direction, one of a medium and the head relative to the other of the medium and the head; and a controller configured to output, to the driving element, a driving signal having a first voltage level or a second voltage level greater than the first voltage level, and to execute recording of an image on the medium by controlling the head to discharge the liquid from the nozzle toward the medium, while controlling the moving mechanism to move the head relative to the medium. In a case that the controller executes the recording on the medium by controlling the head, the controller is configured to: generate the driving signal and output the driving signal to the driving element, at each of a plurality of pieces of unit recording period which are continuous, with a time required for relative movement of one of the medium and the head relative to the other of the medium and the head only by a unit distance corresponding to resolution in the relative moving direction of an image to be recorded on the medium being defined as the unit recording period; control the moving mechanism to move the head relative to the medium selectively at either one of a first velocity and a second velocity slower than the first velocity; allow a voltage level of the driving signal to be the first voltage level in a case that the controller causes the head to move relative to the medium at the first velocity; and allow the voltage level of the driving signal to be the second voltage level in a case that the controller causes the head to move relative to the medium at the second velocity.

In a case that the head is moved relative to the recording medium at the second velocity, the length of the unit recording period becomes longer as compared with another case of moving the head relative to the recording medium at the first velocity, and thus a discharge amount of the liquid to be discharged from the nozzle becomes smaller provided that the driving signal of a same voltage level is output both for the certain and the another cases. In view of this situation, the above-described image recording apparatus makes the voltage level of the driving signal to be greater in the case of moving the head relative to the recording medium at the second velocity, than in the case of moving the head relative to the recording medium at the first velocity. With this, the discharge amount of the liquid discharged from the nozzle can be made substantially same for both the cases, regardless of the velocity at which the head is moved relative to the recording medium. As a result, it is possible suppress any degradation in the quality of an image recorded on the recording medium.

BRIEF DESCRIPTION OF THE DRAWINGS

FIGS. 4A to 4D are views depicting four kinds of driving signals, respectively, FIG. 4E is a view depicting the relationship between unit recording period and the driving signal in a case that a carriage velocity is a normal velocity, and FIG. 4F is a view depicting the relationship between the unit recording period and the driving signal in a case that the carriage velocity is a low velocity.

DESCRIPTION OF THE EMBODIMENTS

Figure 1:
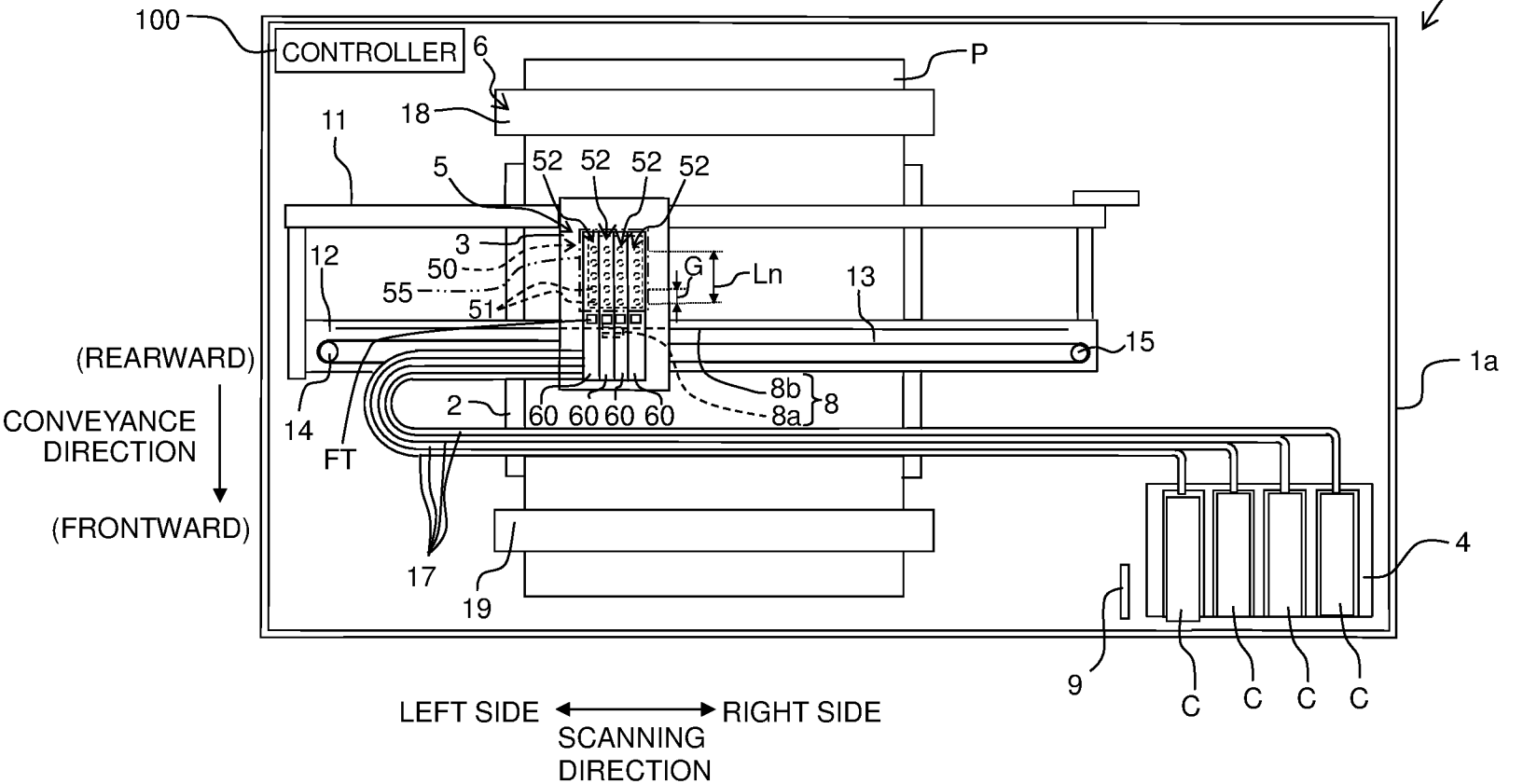
FIG. 1 is a schematic plan view of an ink-jet printer.

Regarding Task to be Solved by Present Embodiment

In the printer of the serial system, normally, a predetermined driving signal is output to the driving element at each of a plurality of pieces of unit recording period which are continuous, with a time required for the carriage to move only by a unit distance corresponding to the resolution of an image to be recorded on a paper sheet being defined as the unit recording period, so as to drive the driving element, thereby recording the image on the paper sheet. Here, in a case that the moving velocity of the carriage is changed as in the above-described publicly known printer, the length of the unit recording period is also changed. As a result, consequently, a driving interval from a time at which the driving of the driving element is ended in certain unit recording period and until a time at which the driving of the driving element is started at a next unit recording period is also changed, as well.

Further, in the driving element such as the piezoelectric element, etc., any residual vibration remains in the ink inside the head for a while (for a certain period of time) after the driving element has been driven. Accordingly, the meniscus of the ink inside the nozzle is vibrated due to the residual vibration for a while after the ink has been discharged. Specifically, immediately after the discharge, the position of the meniscus is at a position moving (protruding) outward from or to the outside of the opening of the nozzle, and then the position of the meniscus is moved back (retreated) to the position of the opening of the nozzle as time passes.

Accordingly, as the length of the unit recording period is shorter and the interval between the times at each of which the driving element is driven is shorter, the position of the meniscus at a time of starting each unit recording period is thereby protruded outward from the opening of the nozzle by being affected by the residual vibration generated by a previous unit recording period performed therebefore. Furthermore, as the position of the meniscus is protruded further outward from the opening of the nozzle at the time of starting the driving of the driving element, a discharge amount of the ink discharged from the nozzle when the driving element is driven becomes greater.

In view of the above-described situation, in a case that the moving velocity of the carriage is changed, the position of the meniscus at the time of starting the unit recording period is changed, which in turn also changes the discharge amount of the ink discharged from the nozzle, resulting in such a fear that the quality of an image recorded on the paper sheet might be degraded or lowered.

Further, as an example of the image recording apparatus, there is also known an image recording apparatus of the line system in which an ink is discharged from nozzles of the head while the paper sheet is conveyed in a state that the head is fixed to thereby record an image on the paper sheet. Also in a case that a conveying velocity of the paper sheet is changed in the image recording apparatus of the line system, the position of the meniscus at the time of staring unit recording period is changed, which in turn also changes the discharge amount of the ink discharged from each of the nozzles, resulting in such a fear that the quality of an image recorded on the paper sheet might be degraded or lowered.

Embodiment

An explanation will be given about the schematic configuration of an ink-jet printer 1 (hereinafter also referred to as a "printer 1", in some cases; corresponding to an "image recording apparatus" of the present disclosure) according to an embodiment of the present disclosure. As depicted in FIG. 1, the printer 1 has a casing 1*a* of which outer shape is a substantially rectangular parallelepiped as a whole. The casing 1*a* is provided with a platen 2, a carriage 3 (corresponding to a "moving mechanism" of the present disclosure), a tank-installing part 4, a head unit 5, a conveying mechanism 6 (corresponding to a "moving mechanism" of the present disclosure), a linear encoder 8, a temperature sensor 9 (corresponding to a "temperature sensor" of the present disclosure), a head-voltage generating circuit 97 (see FIG. 2), a controller 100, etc. Note that in the following explanation, a front side of the sheet surface of FIG. 1 is defined as the "upper side" of the printer 1, and a far side (back side) of the sheet surface of FIG. 1 is defined as the "lower side" of the printer 1. Further, a front-rear direction and a left-right direction as depicted in FIG. 1 are defined as the "front-rear direction" and the "left-right direction", respectively, of printer 1.

A sheet P fed from a non-illustrated feeder is placed on the upper surface of the platen 2. Further, two guide rails 11, 12 extending in parallel with a scanning direction are arranged at a location above the platen 2. The carriage 3 is attached to the two guide rails 11, 12, and is movable in the scanning direction along the two guide rails 11, 12 in an area or region facing the sheet P on the platen 2. Furthermore, a driving belt 13 is attached to the carriage 3. The driving belt 13 is an endless belt wound around two pulleys 14, 15. A pulley 14 as one of the two pulleys 14, 15 is coupled to a carriage motor 16 (see FIG. 2). The pulley 14 is rotary-driven by the carriage motor 16 to thereby cause the driving belt 13 to run, which in turn allows the carriage 3 to reciprocate (move in a reciprocating manner) in the scanning direction.

The tank installing part 4 is arranged on the front side relative to the carriage 3 in the inside of the casing 1*a*. Four ink cartridges C (corresponding to a "liquid tank" of the present disclosure) are detachably installed in the tank installing part 4. The four ink cartridges C store a black ink, a yellow ink, a cyan ink and a magenta ink therein, respectively.

The head unit 5 is mounted on the carriage 3 in a state that the head unit 5 has a gap defined between the head unit 5 and the platen 2, and reciprocates in the scanning direction together with the carriage 3. The head unit 5 has an ink-jet head 50 (hereinafter simply referred to as the "head 50"), and four buffer tanks 60 which are provided on the upper surface of the head 50 and which temporarily store the inks to be supplied to the head 50, respectively. One ends of four ink supply tubes 17 having flexibility are detachably connected to the four buffer tanks 60, respectively. The other ends of the respective four ink supply tubes 17 are connected to the tank installing part 4. The inks inside the four ink cartridges C installed in the tank installing part 4 are supplied to the buffer tanks 60 via the four ink supply tubes 17, respectively. In the present embodiment, a channel which is constructed of each of the ink supply tubes 17 and one of the buffer tanks 60 and which is configured to supply each of the inks from the ink cartridges C to the head 50 corresponds to a "supply channel" of the present disclosure.

The lower surface of the head 50 is a discharge surface 50*a* (see FIG. 3C) formed with a plurality of nozzles 51 via which the ink is discharged. In the discharge surface 50*a*, the plurality of nozzles 51 are aligned in a conveyance direction (front-rear direction) orthogonal to the scanning direction to thereby form a nozzle array 52. Further, the head 50 has four pieces of the nozzle array 52 arranged side by side in the scanning direction. From the plurality of nozzles 51 constructing the four nozzle arrays 52, black, yellow, cyan and magenta inks are discharged in an order from a nozzle array 52 included in the four nozzle arrays 52 and located on the rightmost side in the scanning direction. The detailed configuration of the head 50 will be explained later on.

The conveying mechanism 6 is provided with pairs of conveying rollers 18 and 19. The pairs of conveying rollers 18 and 19 are rotary driven by a conveying motor 20 (see FIG. 2) while being synchronized with each other. The pairs of conveying rollers 18 and 19 cooperates to convey the sheet P placed on the platen 2 in the front direction (conveyance direction). Note that the driving shafts of the pair of conveying rollers 18 are provided with a rotary encoder 40 (see FIG. 2) configured to output a pulsed signal in accordance with the rotation of the pair of conveying rollers 18. The controller 100 controls the conveyance of the sheet P based on the pulsed signal output from the rotary encoder 40.

The linear encoder 8 is provided with a sensor 8*a* attached to the carriage 3 and a scale 8*b* extending in the scanning direction over the movable range of the carriage 3. The scale 8*b* is provided with an index at every predetermined interval (spacing distance). The sensor 8*a* detects the index provided on the scale 8*b* and outputs a detection signal of the detected index to the controller 100. With this, the controller 100 is capable of obtaining the position, the velocity, etc., of the carriage 3 based on the detection signal output by the linear encoder 8, and controls the movement of the carriage 3 based on a result of the obtaining.

The temperature sensor 9 is a sensor having a thermistor, etc., and configured to measure the temperature, and measures the temperature inside the printer 1 and outputs information regarding the temperature to the controller 100. Here, in a case that any change in the temperature occurs in the inside of the printer 1, the temperature(s) of the ink(s) inside the printer 1 also change(s). Namely, the temperature sensor 9 measures the temperature inside the printer 1 having a constant relationship with the temperature(s) of the ink(s). Note that a position or location at which the temperature sensor 9 is arranged is not limited to or restricted by the position indicated in FIG. 1; it is allowable that the temperature sensor 9 is arranged at a position at which the temperature sensor 9 is capable of measuring the temperature of any part or portion, of the printer 1, having the constant relationship with the temperature of the ink(s). Alternatively, it is allowable that the temperature sensor 9 is configured to directly measure the temperature(s) of the ink(s).

Figure 2:
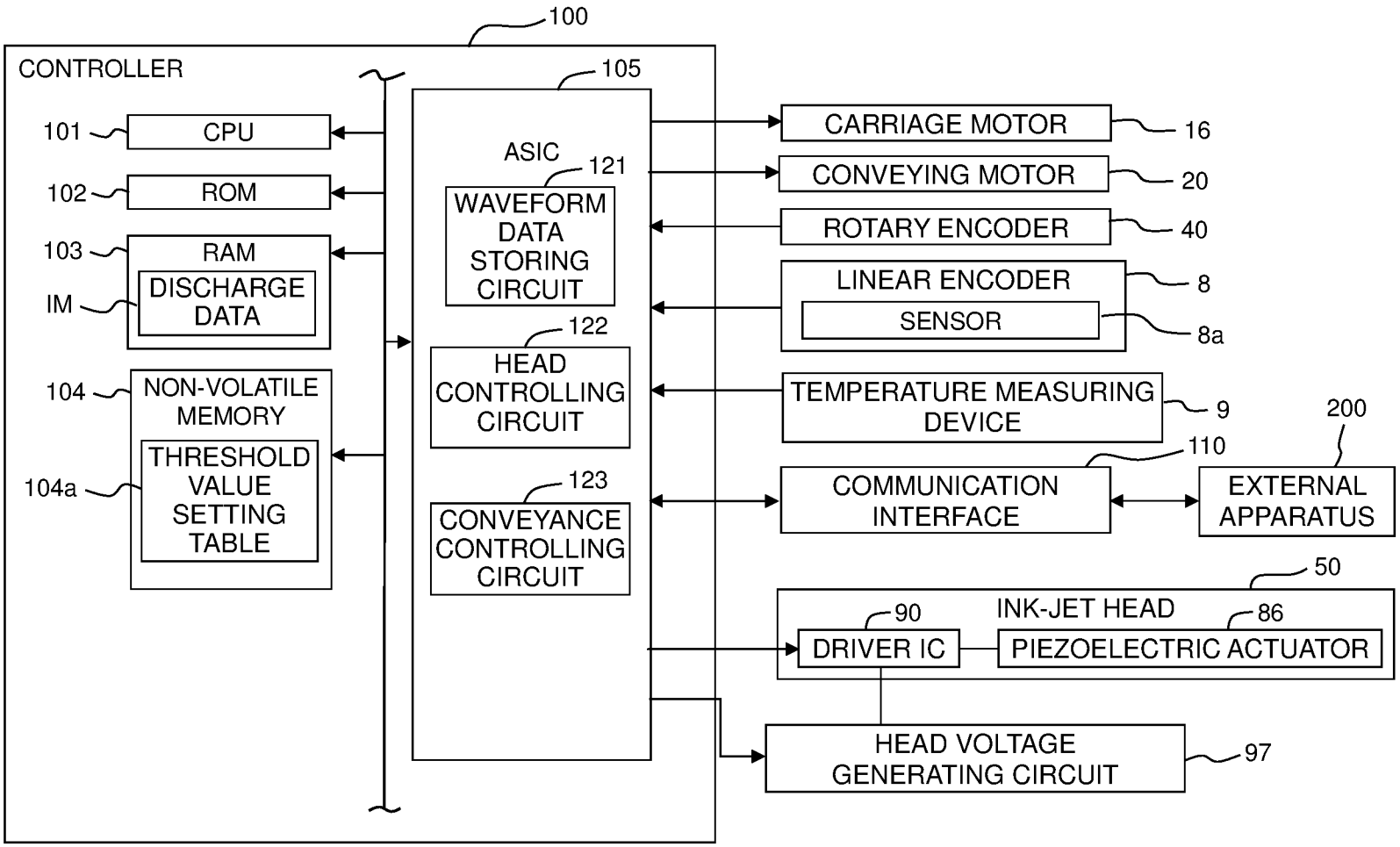
FIG. 2 is a block diagram depicting the electrical configuration of the ink-jet printer.

As depicted in FIG. 2, the controller 100 includes a CPU (Central Processing Unit) 101, a ROM (Read Only Memory) 102, a RAM (Random Access Memory) 103, a non-volatile memory 104, an ASIC (Application Specific Integrated Circuit) 105, etc. The ROM 102 stores therein programs executable by the CPU 101, a variety of kinds of fixed data, etc. The RAM 103 temporality stores data (discharge data IM, etc.) required in a case that a program is to be executed. The non-volatile memory 104 stores therein a threshold value setting table 104*a* (which will be described later on), etc. The ASIC 105 is connected to a variety of kinds of the device, unit, part, etc., of the printer 1 which is exemplified, for example, by the head 50, the carriage motor 16, the conveying motor 20, a communication interface 110, etc.

Note that the controller 100 may be configured such that only the CPU 101 performs a variety of kinds of processing, or that only the ASIC 105 performs the variety of kinds of processing, or the CPU 101 and the ASIC 105 perform the variety of kinds of processing in cooperation. Alternatively, the controller 100 may be configured such that one piece of the CPU 101 solely performs the variety of kinds of processing, or that a plurality of pieces of the CPU 101 perform the variety of kinds of processing in sharing manner Still alternatively, the controller 100 may be configured such that one piece of the ASIC 105 solely performs the variety of kinds of processing, or that a plurality of pieces of the ASIC 105 perform the variety of kinds of processing in sharing manner.

The controller 101 executes a variety of kinds processing such as a recording processing of recording an image on a sheet P, by using the CPU 101 and the ASIC 105, in accordance with a program stored in the ROM 102, and the like. For example, in the recording processing, the controller 100 controls a driver IC 90 (to be described later on) of the head 50, the carriage motor 16, the conveying motor 20, etc., based on a recording command (instruction) input from an external apparatus 200 such as PC (Personal Computer), etc., via the communication interface 110 so as to record an image on the sheet P. Specifically, the controller 100 records a desired image, etc., on one piece (one sheet) of the sheet P by alternately executing a recording pass of discharging the ink(s) while moving the head 3 together with the carriage 3 and a conveying operation of causing the pairs of conveying rollers 18 and 19 to convey the sheet P by a predetermined amount in the conveyance direction. Namely, in a case that an image is recorded on one piece of the sheet P, a plurality of times of recording passes are executed. As described above, the printer 1 of the present embodiment is an ink-jet printer of the serial system.

The specific of the operation in the recording pass is as follows. Namely, the controller 100 firstly accelerates the carriage 3, which is stopped, up to a target velocity. Afterwards, in a case that the moving velocity of the carriage 3 reaches the target velocity, the controller 100 causes the carriage 3 to move at a constant velocity that is the target velocity. During this movement of the carriage at the constant velocity, the controller 100 performs a discharge operation of causing the ink(s) to be discharged from the head 50 toward the sheet P. Then, in a case that the discharge operation in the recording pass is ended, the controller 100 decelerates and stops the carriage 3.

Figure 3A:
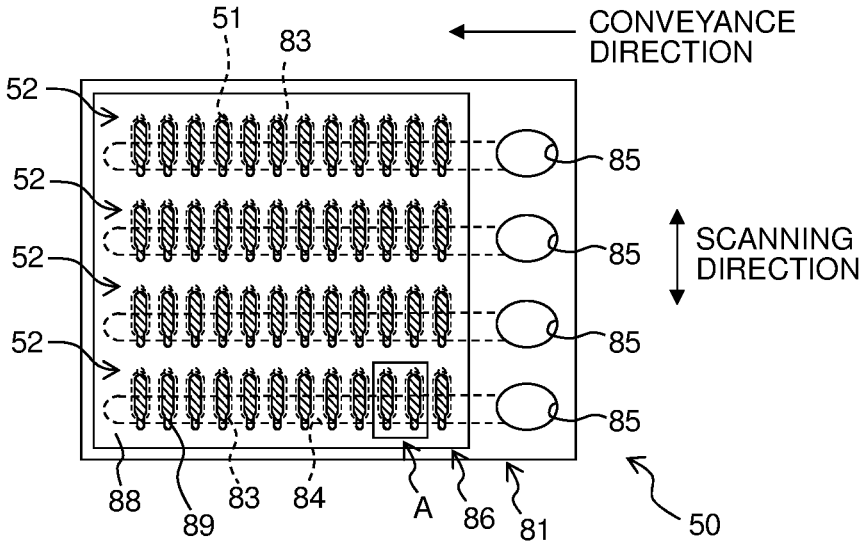
FIG. 3A is a plan view of an ink-jet head.

Next, the head 50 will be explained in detail. As depicted in FIG. 3A, the head 50 is provided with: a channel structure 81 formed with the plurality of nozzles 51 and a plurality of pressure chambers 83 communicating with the plurality of nozzles 51, respectively; and a piezoelectric actuator 86 arranged on the upper surface of the channel structure 81.

Figure 3B:
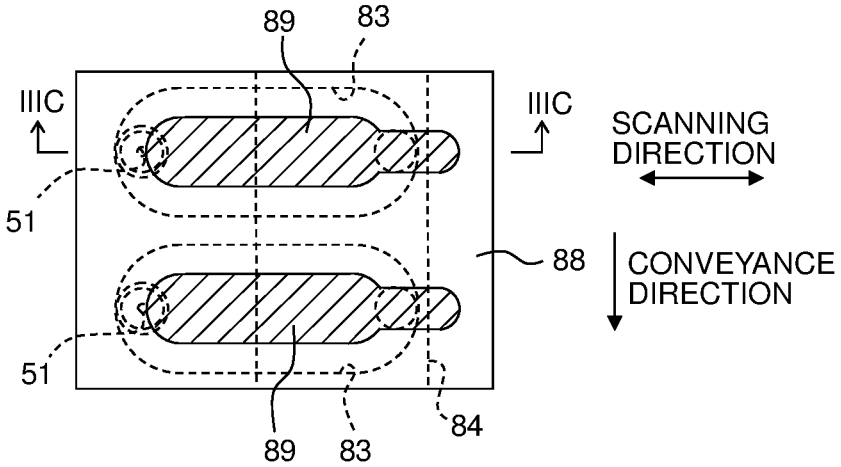
FIG. 3B is an enlarged view of a part "IIIB-IIIB" in FIG. 3A.
Figure 3C:
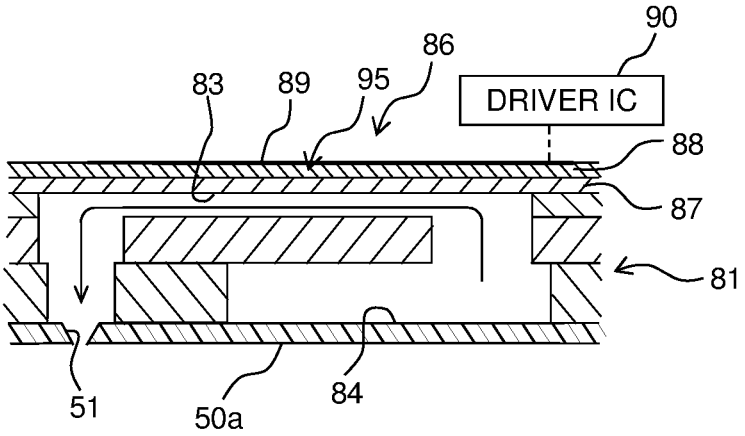
FIG. 3C is a cross-sectional view taken along a line IIIC-IIIC in FIG. 3B.

As depicted in FIG. 3C, the channel structure 81 has a configuration in which four plates are stacked. The plurality of nozzles 51 are formed in the lower surface of the channel structure 81. As depicted in FIG. 3A, the plurality of nozzles 51 are aligned in the conveyance direction and construct four nozzle arrays 52 corresponding to the four color inks, respectively. The plurality of pressure chambers 83 are aligned to form four pressure chamber arrays, in a similar manner to the plurality of nozzles 51.

Further, as depicted in FIGS. 3A and 3B, the channel structure 81 is formed with four manifolds 84 each of which extends in the conveyance direction. The four manifolds 84 supply the four color inks to the four pressure chamber arrays, respectively. Furthermore, the four manifolds 84 are connected to ink supply ports 85 which are formed in the upper surface of the channel structure 81. The four color inks are supplied from four buffer tanks 60 to the four ink supply ports 85, respectively. Moreover, a filter FT configured to filter any foreign matter, debris, dust, etc., in the ink is provided on each of the ink supply ports 85. With the above-described configuration, an internal channel from each of the ink supply ports 85 up to one of the nozzles 51 are formed in the inside of the channel structure 81.

As depicted in FIG. 3C, the piezoelectric actuator 86 is provided with a vibration plate 87 covering the plurality of pressure chambers 83, a piezoelectric layer 88 arranged on the upper surface of the vibration plate 87, and a plurality of individual electrodes 89 corresponding to the plurality of pressure chambers 83, respectively. Each of the plurality of individual electrodes 89 located on the upper surface of the piezoelectric layer 88 is electrically connected to the driver IC 90 which drives the piezoelectric actuator 86.

The vibration plate 87 located on the lower surface of the piezoelectric layer 88 is formed of a metallic material, and functions as a common electrode which faces (is opposite to) the plurality of individual electrodes 89 with the piezoelectric layer 88 being intervened therebetween. Note that the vibration plate 87 is connected to the driver IC 90 and is always maintained at the ground potential. As depicted in FIG. 2, the head-voltage generating circuit 97 is connected to the driver IC 90. The head-voltage generating circuit 97 is a circuit which generates a driving voltage for driving the head 50, based on an AC voltage supplied from an AC power source, and which outputs the generated driving voltage to the driver IC 90. Further, the head-voltage generating circuit 97 is controlled by the controller 100 so that the head-voltage generating circuit 97 is capable of adjusting the voltage value of the driving voltage which is to be output to the driver IC 90.

In the above-described configuration, one piece of the individual electrodes 89, an electrode part, of the vibration plate 87 as the common electrode, which faces one piece of the pressure chambers 83, and a part or portion of the piezoelectric layer 88 which faces one piece of the pressure chambers 83 construct one piece of piezoelectric elements 95 (see FIG. 3C).

The driver IC 90 outputs a driving signal which is a predetermined pulse signal, based on a control signal from the controller 100, with respect to the individual electrode 89 of each of the piezoelectric elements 95, and switches the potential of the individual electrode 89 between a positive potential and the ground potential. In the present embodiment, as a system for driving the piezoelectric actuator 86, a so-called "pull striking system" by which the ink is supplied to the inside of the pressure chamber 83 before the ink is discharged (jetted). Specifically, the individual electrode 89 is previously maintained at the positive potential. In this situation, a difference in the potential is generated between the individual electrode 89 and the vibration plate 87 as the common electrode which is maintained at the ground potential, thereby causing the part, of the piezoelectric layer 88, which is sandwiched between the individual electrode 89 and the vibration plate 87 is piezoelectrically deformed. With this, the vibration plate 87 and the piezoelectric layer 88 are bent to project toward the side of the pressure chamber 83, thereby providing a stand-by state in which the volume of the pressure chamber 83 is decreased.

Afterwards, a discharge pulse S (to be described later on) is applied to the individual electrode 89 and thus the potential of the individual electrode 89 becomes to be the ground potential, the piezoelectric deformation of the piezoelectric layer 88 is thus ended once. With this, the vibration plate 87 and the piezoelectric layer 88 are allowed to be in a horizontal state without any bending, which in turn increases the volume inside the pressure chamber 83, as compared with the stand-by state provided previously.

Accompanying with this, the ink is supplied from the manifold 84 to the pressure chamber 83. Afterwards, the potential of the individual electrode 89 is made to be the normal potential again, which in turn decreases the volume of the pressure chamber 83. At this time, the pressure (discharging energy) is applied to the ink inside the pressure chamber 83, and a droplet of the ink is discharged from a nozzle 51 included in the plurality of nozzles 51 and communicating with the pressure chamber 83.

Next, the specifics of the electrical configuration for driving the above-described piezoelectric actuator 86 will be explained. Firstly, the driver IC 90 which supplies the driving signal to the piezoelectric actuator 86 will be explained.

The driver IC 90 is controlled by the controller 100 and causes the piezoelectric actuator 86 of the head 50 to perform the discharge operation of causing the ink(s) to be discharged from the nozzles 51. Specifically, during the recording pass, the driver IC 90 outputs a driving signal having a predetermined voltage level with respect to each of the individual electrodes 89 of the piezoelectric actuator 86, at each of a plurality of pieces of unit recording period which are temporarily continuous, to thereby perform the above-described switching of the potential of each of the individual electrodes 89. Note that the term "unit recording period" means a time required for the head 50 to move only by a unit distance which corresponds to the resolution in the scanning direction of an image which is to be recorded on the sheet P. Namely, the controller 100 outputs the driving signal to each of the individual electrodes 89 every time the controller 100 determines that the head 50 has been moved only by the unit distance, based on the detection signal of the linear encoder 8.

Here, in the present embodiment, as a discharge amount (volume of a droplet of the ink (ink droplet) dischargeable from the nozzle 51 within the unit recording period, so as to record an image, etc., on the sheet P, there are four kinds of the discharge amounts (a large droplet, a middle droplet, a small droplet and non-discharge). As the kinds of the driving signal output with respect to the individual electrode 89, there are four kinds of the driving signals which are: a large droplet-discharging signal, a middle droplet-discharging signal, a small droplet-discharging signal and a non-discharge signal, corresponding to the four kinds of the discharge amount, respectively, as depicted in FIGS. 4A to 4D.

The large droplet-discharging signal is a driving signal including three discharge pulses S. The middle droplet-discharging signal is a driving signal including two discharge pulses S. The small droplet-discharging signal is a driving signal including one discharge pulse S. On the other hand, the no-discharge signal is a driving signal including no discharge pulses S. As described above, the discharge pulse S is applied to the individual electrode 89 so as to apply pressure to the ink inside the pressure chamber 83, thereby allowing the ink droplet to be discharged from the nozzle 51. Accordingly, as the driving signal have a larger number of the discharge pulse S, the discharge amount of the ink discharged from the nozzle 51 become to be greater.

Note that the length of waveform (waveform length) of the discharge signal is shorter than the length of the unit recording period. Accordingly, in addition to the discharge signal, an added signal which has no discharge pulse (indicated with one-dot chain lines in FIGS. 4B to 4D) is added after the discharge signal over a length obtained by deducting the waveform length of the discharge signal from the length of the unit recording period, and is output with respect to the piezoelectric element 95, at each of the plurality of pieces of unit recording period which are continuous.

The driver IC 90 receives, from the controller 100, four kinds of waveform data regarding the pulse waveforms of the four kinds of driving signals, and waveform selecting data. The waveform selecting data is data for selecting one waveform data from the four kinds of waveform data, with respect to each of the piezoelectric elements 95, at each of the plurality of pieces of unit recording period which are continuous. The driver IC 90 selects, at each of the plurality of pieces of unit recording period which are continuous, one waveform data from the four kinds of waveform data, with respect to each of the piezoelectric elements 95, based on the waveform selecting data. Further, the driver IC 90 amplifies the selected waveform data up to a voltage level (VL) corresponding to the driving voltage received from the head-voltage generating circuit 97 to thereby generate the driving signal, and outputs the generated driving signal to the individual electrode 89 of each of the piezoelectric elements 95.

Next, the configuration of the ASIC 105 of the controller 100 which performs the above-described driving of the piezoelectric actuator 86, etc., will be explained. As depicted in FIG. 2, the ASIC 105 has a waveform data storing circuit 121, a head controlling circuit 122 and a conveyance controlling circuit 123 which are integrated in the ASIC 105. The waveform data storing circuit 121 stores waveform data regarding the pulse waveform of each of the four kinds of driving signals which are output by the driver IC 90. The head controlling circuit 122 controls each of the driver IC 90 of the head 50 and the carriage motor 16, based on the discharge data IM stored in the RAM 103, in the recording processing of recording an image on the sheet P. The conveyance controlling circuit 123 controls the conveyance motor 20, also in the recording processing, to thereby convey the sheet P in the conveyance direction. In the following, the head controlling circuit 122 will be explained in detail.

The head controlling circuit 122 performs a selecting processing of selecting one kind of driving signal, among the four kinds of driving signals, with respect to each of the nozzles 51 (individual electrodes 89), at each of the plurality of pieces of unit recording period which are continuous, based on the discharge data IM stored in the RAM 103. Further, the head controlling circuit 122 transmits, to the driver IC 90, selection data indicating the driving signal selected in the selecting processing, and the waveform data stored in the waveform data storing circuit 121, and causes the driver IC 90 to generate any one of the four kinds of driving signals based on the selection data and the waveform data. This generated driving signal is supplied to each of the plurality of individual electrodes 89 of the piezoelectric actuator 86, to thereby cause the ink to be discharged selectively from one of the nozzles 51 corresponding to each of the plurality of individual electrodes 89, at each unit recording period.

Figure 5A:
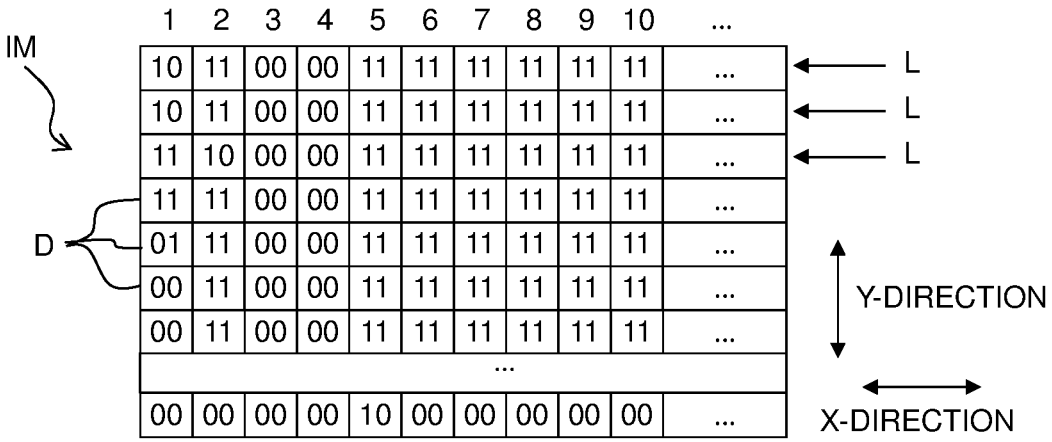
FIG. 5A is a view depicting discharge data.

In the following, before providing a detailed explanation on the selecting processing executed by the head controlling circuit 122, the discharge data IM will be firstly explained. As depicted in FIG. 5A, the discharge data IM has a plurality of dot elements D corresponding, respectively, to a plurality of dots (including non-discharge dots with which the ink is not landed) which are formed on the sheet P. Specifically, the discharge data IM is formed of a plurality of dot elements D which are arranged in an X-direction and a Y-direction which are orthogonal to each other. The X-direction and the Y-direction correspond to the scanning direction and the conveyance direction, respectively.

A discharge amount of the ink, in which the ink is to be discharged from each of the nozzles 51 in a case of forming a dot corresponding to each of the dot elements D, is set in each of the dot elements D. Specifically, any one of the above-described four kinds of discharge amounts (large droplet, middle droplet, small droplet and non-discharge) which are dischargeable from the nozzle 51 within the unit recording period is set with respect to each of the dot elements D. Note that in the discharge data IM indicated in FIG. 5B, the four kinds of discharge amounts which are set with respect to each of the dot elements D as "00", "01", "10" and "11". The discharge amount "00" corresponds to the "non-discharge", the discharge amount "01" corresponds to the "small droplet", the discharge amount "10" corresponds to the "middle droplet", and the discharge amount "11" corresponds to the "large droplet".

Further, the discharge data IM has a plurality of pieces of raster data L corresponding respectively to a plurality of lines. Note that raster data L corresponding to one line is a dot element array in which a plurality of dot elements D, corresponding to a plurality of dots aligned along the scanning direction on the sheet P, are aligned in accordance with an alignment order of the plurality of dots corresponding to the plurality of the dot elements D along the scanning direction. Furthermore, each of the plurality of pieces of raster data L corresponding respectively to the plurality of lines corresponds to one of the nozzles 51. Namely, the plurality of dot elements D of the raster data L is dot elements D corresponding to the dots which are formed by the ink discharged from a nozzle 51, among the plurality of nozzles 51, corresponding to the raster data L, at each of the plurality of pieces of unit recording period which are continuous in the recording processing. Namely, in other words, the raster data L is such data in which the discharge amount of the ink, to be discharged from the nozzle 51 at each of the plurality of pieces of unit recording period which are continuous in the recording pass, is set. In FIG. 5A and in FIG. 5B which will be explained later on, reference numerals affixed on the upper side of the raster data L each indicate as to a dot element D, having the reference number affixed thereto, corresponds to unit recording period of which ordinal number from the time of staring the recording pass.

The head controlling circuit 122 selects, with respect to each of the plurality of pieces of unit recording period which are continuous, the driving signal corresponding to the discharge amount set with respect to each of the plurality of pieces of unit recording period which are continuous, based on the raster data L of the discharge data IM. For example, the head controlling circuit 122 selects the small droplet discharge signal with respect to a recording period for which the discharge amount of the "small droplet" is set.

In the head 50, in a case that the ink is discharged from a certain nozzle 51 among the plurality of nozzles 51, the pressure of the ink in the manifold 84, communicating with the certain nozzle 51 is decreased. Normally, in response to the decrease in the pressure in the manifold 84, the ink flows into the manifold 84 from the ink cartridge C, and thus the pressure of the ink inside the manifold 84 is restored as time passes. However, in a case that a state in which the ink is discharged from a large number of the nozzles 51 at a time during the execution of the recording pass is lasted or continued, a discharge amount of the ink discharged within a predetermined period of time (time) is increased. As a result, the discharge amount of the ink per unit time from the head 50 becomes greater than a supply amount of the ink to the head 50 per unit time, thereby leading to such a fear that any short supply of the ink to the head 50 (under-refill) might occur. Further, in a case that such the short supply of the ink occurs as described above, there is such a fear that the ink might not be normally discharged from the nozzles 51.

In view of this situation, in a case that there is no fear that any short supply of the ink might occur during the execution of a certain recording pass, the controller 100 determines a target velocity of a moving velocity of the carriage 3 (hereinafter referred to simply as a "carriage velocity", as well) in the certain recording pass to be a normal velocity (corresponding to a "first velocity" of the present disclosure). On the other hand, in a case that there is any fear that any short supply of the ink might occur during the execution of the certain recording pass, the controller 100 determines the carriage velocity in the certain recording pass to be a low velocity (corresponding to a "second velocity" of the present disclosure) which is slower than the normal velocity. With this, since a length of unit recording period becomes long (a discharging interval of the ink becomes long), it is possible to suppress such a situation that the discharge amount of the ink from the head 50 per unit time becomes greater than the supply amount of the ink to the head 50 per unit time. In the following, a processing performed by the controller 100 as a countermeasure for the short supply of the ink will be explained specifically.

Note that among the four color inks, the black ink normally has a high viscosity and is discharged in a large discharge amount per unit time during the execution of recording pass, as compared with the other color inks. Accordingly, the short supply of the black ink tends to occur easily, as compared with the other color inks.

In view of this situation, the controller 100 calculates and obtains a duty (corresponding to "information regarding a liquid discharge amount of the liquid" of the present disclosure) in a case of executing of the recording pass, based on the discharge data IM stored in the RAM 103. The term "duty" means a ratio of an actual discharge amount of the black ink which is actually discharged in a certain recording pass to a maximum discharge amount (duty 100%) of the black ink discharged from all the nozzles which discharge the black ink in the certain recording pass.

In a case that the obtained duty in the certain recording pass is less than a threshold value, the controller 100 determines that there is no fear that the short supply of the ink might occur, and determines the carriage velocity in the certain recording pass to be the normal velocity. On the other hand, in a case that the obtained duty in the certain recording pass is not less than the threshold value, the controller 100 determines that there is a fear that the short supply of the ink might occur, and determines the carriage velocity in the certain recording pass to be the low velocity. As a modification, it is allowable that the controller 100 calculates the duty, in the case of executing the recording pass, for each of the four color inks; and that in a case that the duty in at least any one of the four color inks is not less than the threshold value, the controller 100 determines the carriage velocity in the certain recording pass to be the low velocity.

Note that in the present embodiment, the threshold value which is compared with the duty is not a fixed value, and is a value which is adjusted in accordance with a temperature indicated by temperature information output from the temperature sensor 9. Specifically, the non-volatile memory 104 stores therein a threshold value setting table 104*a* indicating the relationship between the temperature indicated by the temperature information output from the temperature sensor 9 and the threshold value. Further, the controller 100 determines a threshold value which corresponds, in the threshold value setting table 104*a*, to the temperature indicated by the temperature information output from the temperature sensor 9, as the threshold value which is to be compared with the duty. Here, as the temperature of the ink becomes higher, the viscosity of the ink is lower and the flow resistance in the ink is lower. Accordingly, as the temperature of the ink is higher, the ink flows more easily and the short supply of the ink is less likely to occur. Therefore, the threshold value setting table 104*a* is set such that as a temperature indicated by the temperature information output from the temperature measuring apparatus 9 is higher, the value of the threshold value corresponding to the temperature becomes greater. As described above, since the threshold value is adjusted in accordance with the temperature of the ink, it is possible to make the determination, highly precisely, as to whether or not there is such a fear that the short supply of the ink might occur. In the present embodiment, the "information regarding a supply state of the liquid from the liquid tank to the head" of the present disclosure corresponds to information including the duty and the temperature information output from the temperature sensor 9.

In the present embodiment, by determining the carriage velocity in each of the recording passes, selectively between the normal velocity and the low velocity as described above, there is such a possibility that, in a plurality of recording passes which are executed a plurality of times in a case of recording an image on one sheet of the sheet P, a recording pass wherein the carriage velocity is the low velocity and a recording pass wherein the carriage velocity is the normal velocity are present in a mixed manner. In view of this situation, the disclosing person of the present disclosure found out that in a case that there are the recording pass wherein the carriage velocity is the low velocity and the recording pass wherein the carriage velocity is the normal velocity are present in a mixed manner, there is such a possibility that the quality of the image recorded on the sheet P might be degraded. In the following, an explanation for this possibility will be given in detail.

In a case that the driving signal is output to the piezoelectric element 95 and the piezoelectric element 95 is driven, any residual vibration remains in the ink inside the pressure chamber 83 for a while (for a certain period of time) after the piezoelectric element 95 has been driven. Accordingly, the meniscus of the ink inside the nozzle 51 is vibrated due to the residual vibration for a while after the ink has been discharged. Specifically, immediately after the discharge, the position of the meniscus is at a position moving (protruding) outward from the opening of the nozzle 51, and then the position of the meniscus is moved back (retreated) to the position of the opening of the nozzle 51 as time passes.

Accordingly, in a case that the carriage velocity is the normal velocity, the length of the unit recording period is shorter than a case that the carriage velocity is the low velocity, the position of the meniscus at the time of starting each of the plurality of pieces of unit recording period which are continuous is thus protruded outward from the opening of the nozzle 51 by being affected by the residual vibration generated by another unit recording period which has been performed therebefore. Further, as the position of the meniscus is protruded further outward from the opening of the nozzle 51 at the time of starting the driving of the piezoelectric element 95, a discharge amount of the ink which is discharged from the nozzle 51 when the piezoelectric element 95 is driven becomes greater.

Accordingly, in a case that the driving signal of a same voltage level and with a same waveform as in a certain recording pass in which the carriage velocity is the normal velocity is output in another recording pass in which the carriage velocity is the low velocity, since the effect of the residual vibration generated in unit recording period which has been performed therebefore is smaller in the another recording pass as compared with the certain recording pass with the normal velocity, the discharge amount of the ink which is discharged from the nozzle 51 becomes smaller in the another recording pass. With this, there is such a fear that any unevenness in the density might occur between an image recorded by the certain recording pass in which the carriage velocity is the normal velocity and an image recorded by the another recording pass in which the carriage velocity is the low velocity, resulting in any degradation in the quality of the image.

In view of this situation, in the present embodiment, the controller 100 causes the head-voltage generating circuit 97 to generate a normal voltage (corresponding to a "first driving voltage" of the present disclosure) in a case that the controller 100 executes a recording pass in which the carriage velocity is the normal velocity. By doing so, the voltage level of the driving signal output to the piezoelectric element 95 becomes a first voltage level VL1 corresponding to the normal voltage, as depicted in FIG. 4E. On the other hand, the controller 100 causes the head-voltage generating circuit 97 to generate a high voltage (corresponding to a "second driving voltage" of the present disclosure) which is higher than the normal voltage in a case that the controller 100 executes a recording pass in which the carriage velocity is the low velocity. By doing so, the voltage level of the driving signal output to the piezoelectric element 95 becomes a second voltage level VL2 corresponding to the high voltage, as depicted in FIG. 4F. The second voltage level VL2 is greater than the first voltage level VL1. Note that the driving signal of the first voltage level VL1 output with respect to the piezoelectric element 95 in the case that the carriage velocity is the normal velocity has a same pulse width and a same number of pulses in unit recording period as those in the driving signal of the second voltage level VL2 output with respect to the piezoelectric element 95 in the case that the carriage velocity is the low velocity, but has different voltage level with that in the driving signal of the second voltage level VL2.

Further, in the present embodiment, the first voltage level VL1 and the second voltage level VL2 are set such that the discharge amount of the ink to be discharged from the nozzle 51 by the output of the driving signal to the piezoelectric element 95 become same in either one of the case that the carriage velocity is the normal velocity and the case that the carriage velocity is the low velocity, in certain unit recording period in which the residual vibration remains in the ink inside the pressure chamber 83 due to the driving of the piezoelectric element 95 in another unit recording period performed immediately before the certain unit recording period.

Figure 5B:
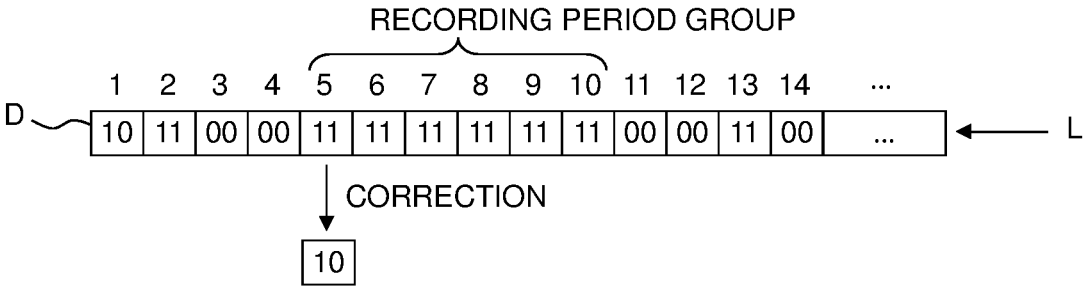
FIG. 5B is a view for explaining correction of the discharge data.

Specifically, as depicted in FIG. 5B, in a case that a recording period group including unit recording periods, among the plurality of pieces of unit recording period, which are continuous and in each which the discharge amount of "11" corresponding to the "large droplet" is set, is present in the raster data L of the discharge data IM, any residual vibration in the ink inside the pressure chamber 83, generated in a certain unit recording period which has been performed immediately before another unit recording period of which ordinal number is second or thereafter in the recording group, remains in the another unit recording period of which ordinal number is second or thereafter in the recording period group. The second voltage level LV2 is set in advance, at a time of shipment from a factory, etc., such that the discharge amount of the ink to be discharged from the nozzle 51 becomes same in the unit recording period of which ordinal number is second or thereafter in the recording period group even in a case that the carriage velocity is changed from the normal velocity to the low velocity.

As described above, by adjusting the voltage level of the driving signal in accordance with the carriage velocity, it is possible to make, with respect to unit recording period of which ordinal number is second or thereafter in the recording period group, the discharge amount of the ink which is to be discharged from the nozzle 51 to be same, regardless of the carriage velocity. On the other hand, at the time of starting the first unit recording period in the record period group, the piezoelectric element 95 has not been driven in another unit recording period immediately therebefore, and thus no residual vibration remains in the ink inside the pressure chamber 83. Accordingly, in a case of lowering the carriage velocity from the normal velocity to the low velocity, actually, there is no need to change, regarding the first unit recording period, the voltage level of the driving signal to be output to the piezoelectric element 95. Namely, in a case that a recording pass is executed with the carriage velocity which is made to be the low velocity and that the voltage level of the driving signal is made to be greater than in another case of executing the recording pass with the carriage velocity which is made to be the normal velocity, the discharge amount of the ink to be discharged from the nozzle 51 becomes great with respect to the first unit recording period.

In view of the above-described situation, in a case that the recording pass is executed with the carriage velocity being made to be the low velocity, the controller 100 changes the driving signal, which is to be output with respect to the first unit recording period in the recording period group, to be a driving signal in which the discharge amount is made to be smaller than the driving signal selected based on the discharge data IM stored in the RAM 103. In the present embodiment, this change of the driving signal is executed by correcting the discharge data IM. Specifically, the controller 100 stores the discharge data IM, which is stored in the RAM 103, in a non-illustrated buffer; and the controller 100 performs, on this buffer, such a correction that decreases the discharge amount set with respect to a first unit recording period in the recording period group, as depicted in FIG. 5B. For example, in a case that the discharge amount set with respect to the first unit recording period in the recording period group is "11", the controller 100 corrects the discharge amount to be "10"; in another case that the discharge amount set with respect to the first unit recording period in the recording period group is "10", the controller 100 corrects the discharge amount to be "01". Note that, however, in a case that the discharge amount set with respect to the first unit recording period in the recording period group is "01", the controller 100 does not performs the correction. By correcting the discharge data as described above, it is possible to make, also with respect to the first unit recording period, it is possible to make the discharge amount of the ink to be discharged from the nozzle 51 to be substantially same, regardless of the carriage velocity.

As described above, by adjusting the voltage level of the driving signal and by changing the driving signal, it is possible to suppress any degradation in the quality of the image to be recorded on the sheet P, even in a case that a plurality of recording passes which are to be executed in a case of recording an image on one piece of sheet P include the recording pass wherein the carriage velocity is the low velocity and the recording pass wherein the carriage velocity is the normal velocity which are present in a mixed manner.

Figure 6A:
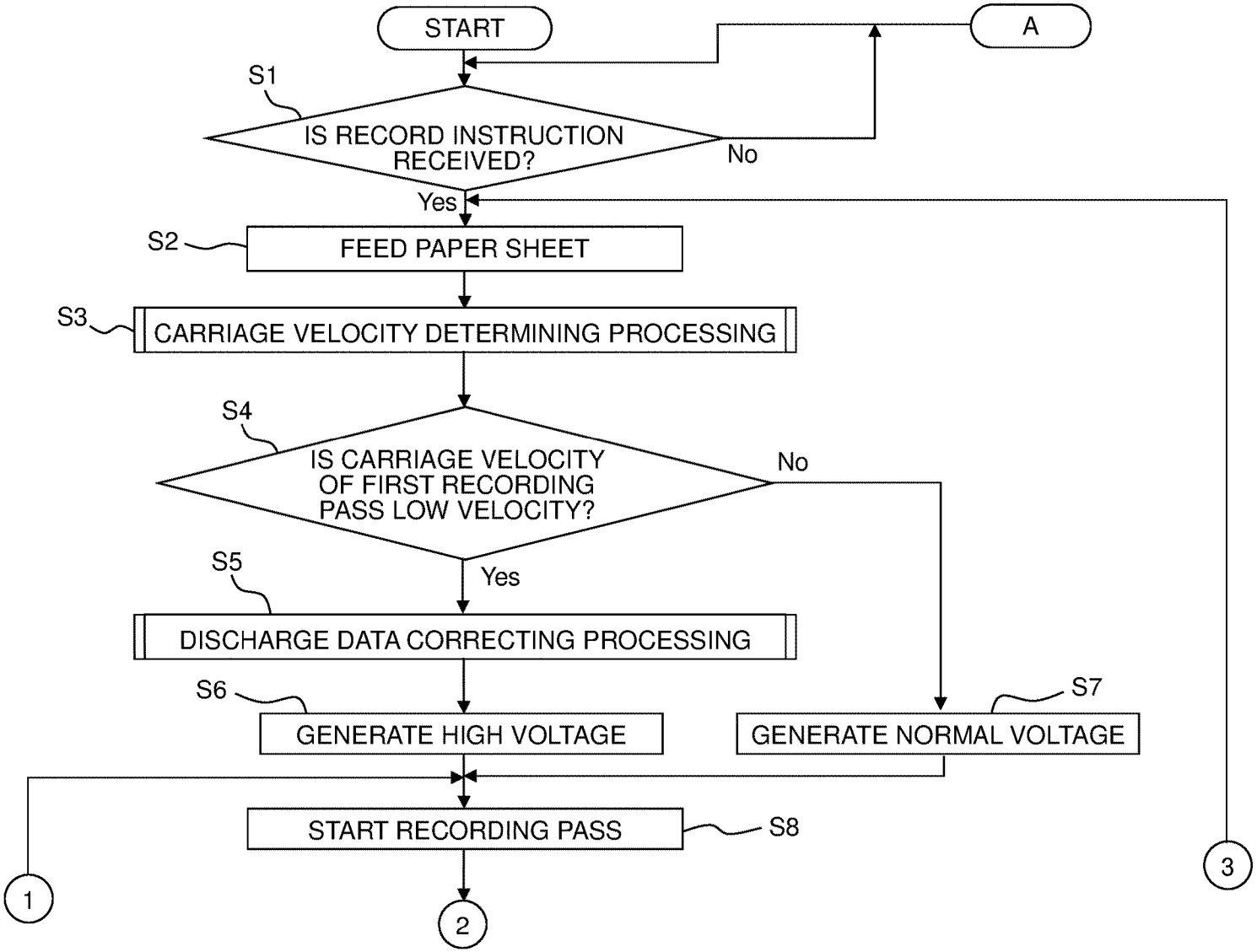
FIGS. 6A, 6B and 6C indicate a flow chart depicting an operation of the ink-jet printer.
Figure 6B:
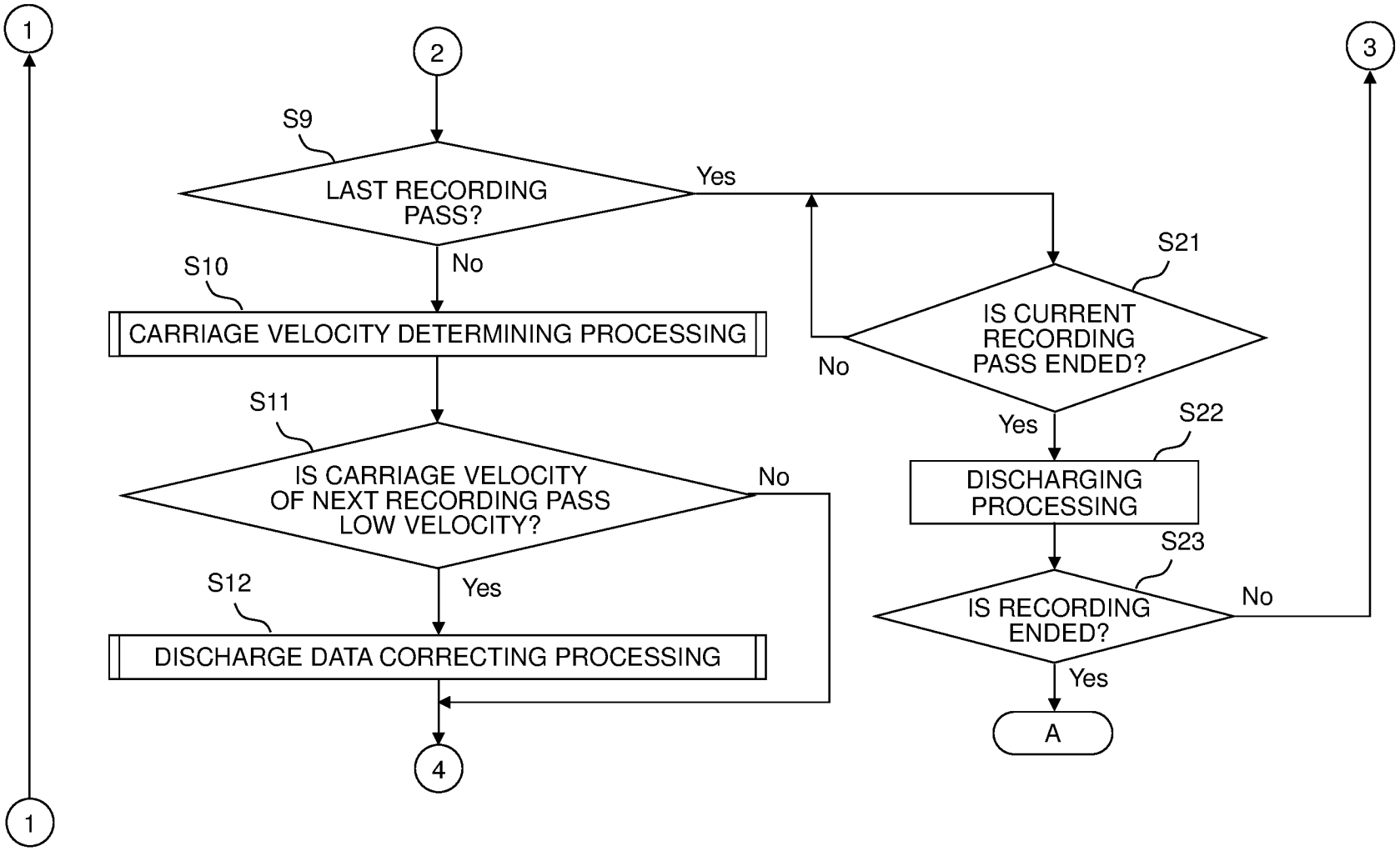
Figure 6C:
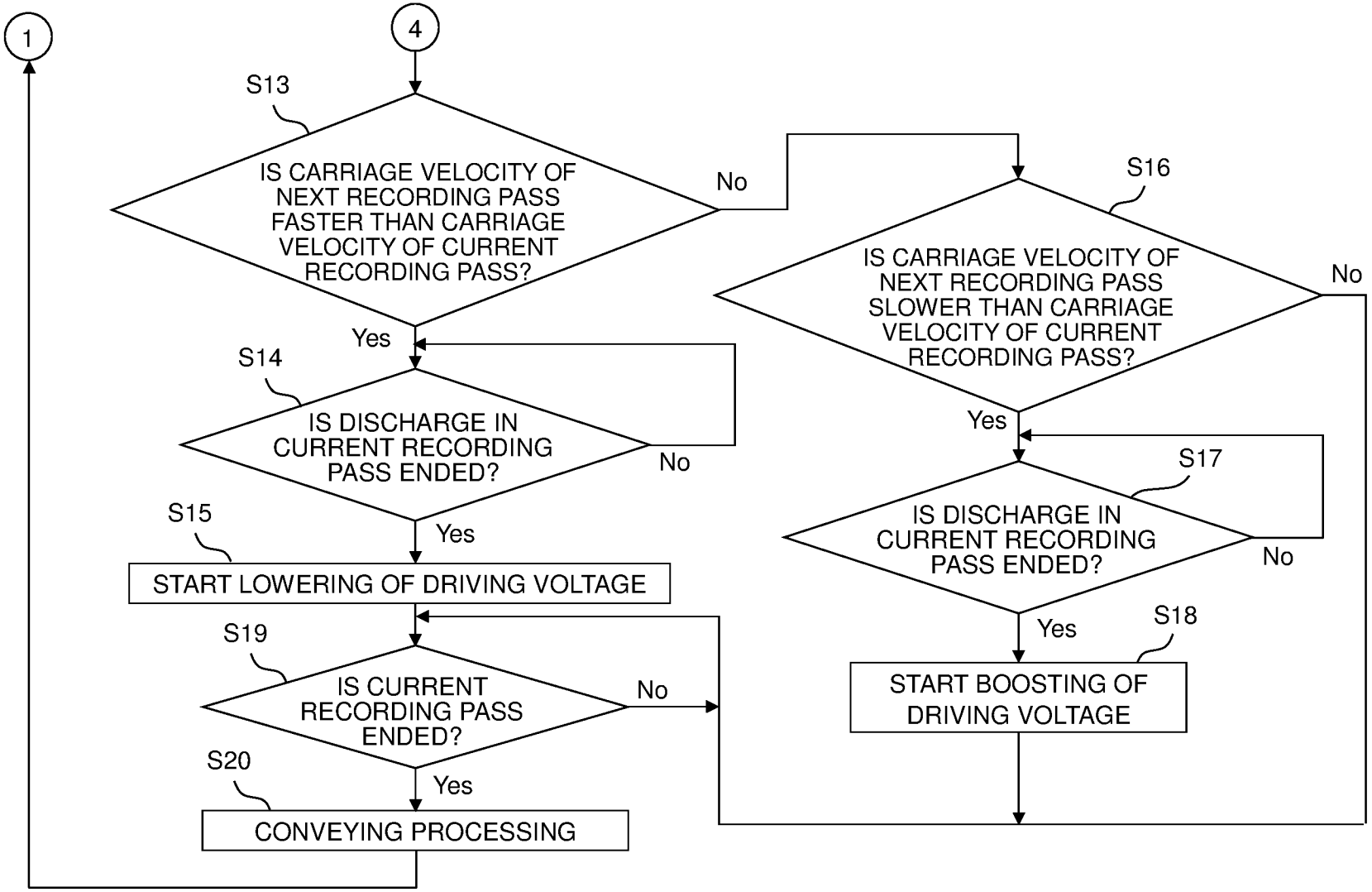

In the following, an example of a series of processing operations of the printer 1 will be explained, with reference to FIGS. 6A to 6C.

In a case that the controller 100 receives a recording command (recording instruction) from the external apparatus 200 (S1: YES), the controller 100 feeds a sheet P from the non-illustrated feeding section to a position at which the sheet P is capable of facing (of being opposite to) the head 50 (S2). Afterwards, the controller 100 executes a carriage velocity determining processing (S3) which will be explained later with reference to FIG. 7. In the carriage velocity determining processing, carriage velocity with respect to the first recording pass (next recording pass) is determined by the controller 100.

Next, the controller 100 determines or judges as to whether or not the carriage velocity determined in the carriage velocity determining processing of S3 is the low velocity or the normal velocity (S4). In a case that the controller 100 determines that the carriage velocity determined in the carriage velocity determining processing is the low velocity (S4: YES), the controller 100 performs a discharge data correcting processing which will be explained later on with reference to FIGS. 8A and 8B (S5). In this discharge data correcting processing, in data corresponding to the first recording pass (next recording pass) in the discharge data IM, the controller 100 performs such a correction that lowers the discharge amount which is set with respect to a first unit recording period in a recording period group including unit recording periods, among a plurality of pieces of the unit recording period, which are continuous and in each of which the discharge amount set based on the discharge data IM is greater than 0 (zero). Next, the controller 100 causes the head-voltage generating circuit 97 to generate the high voltage (S6).

In a case that the controller 100 determines in the processing of S4 that the carriage velocity determined in the carriage velocity determining processing in S3 is the normal velocity (S4: NO), the controller 10 causes the head-voltage generating circuit 97 to generate the normal voltage (S7).

After the processing of S6, or after the processing of S7, the controller 100 starts the recording pass of discharging the ink from the nozzle 51 by causing the piezoelectric element 95 to output the driving signal based on the discharge data IM while driving the carriage motor 16 to move the carriage 8 (S8). Afterwards, the controller 100 determines as to whether or not a recording pass which is currently being executed (in the following, simply referred to as a "current recording pass") is a last recording pass which is executed last in a case of recording an image on one piece of the sheet P (S9). In a case that the controller 100 determines that the current recording pass is not the last recording pass (S9: NO), the controller 100 executes a carriage velocity determining processing which is similar to that in S3 (S10) so as to determine the carriage velocity in a next recording pass. Afterwards, the controller 100 determines as to whether or not the carriage velocity for the next recording pass determined in the carriage velocity determining processing in S10 is the low velocity or the normal velocity (S11). In a case that the controller 100 determines that the carriage velocity of the next recording pass determined in the carriage velocity determining processing in S10 is the low velocity (S11: YES), the controller 100 executes a discharge data correcting processing which is similar to that in the processing of S5 (S12).

After the processing of S12, or in a case that the controller 100 determines that the carriage velocity of the next recording pass is the normal velocity (S11: NO), the controller 100 determines as to whether or not the carriage velocity of the next recording pass is faster than the carriage velocity of the current recording pass (S13). Namely, the controller 100 determines as to whether or not the carriage velocity of the current recording pass is the low velocity and whether or not the carriage velocity of the next recording pass is the normal velocity. Further, in a case that the controller 100 determines that the carriage velocity of the next recording pass is faster than the carriage velocity of the current recording pass (S13: YES), the controller 100 determines as to whether or not the ink discharging operation of the current recording pass is ended (S14). In a case that the controller 100 determines that the ink discharging operation is not ended (S14: NO), the controller 100 stands by until the discharging operation is ended.

Then, in a case that the controller 100 determines that the ink discharging operation is ended (S14: YES), the controller 100 causes the head-voltage generating circuit 97 to start a voltage lowering operation of performing lowering from the high voltage to the normal voltage (S15). Namely, by utilizing a period (time period) which is included in the current recording pass and during which the carriage 3 is decelerated, the controller 100 causes the head-voltage generating circuit 97 to perform the voltage lowering operation. In a case that the processing of S15 is ended, the controller 100 proceeds to a processing of S19.

In a case that the controller 10 determines, in the processing of S13, that the carriage velocity of the next recording pass is not faster than the carriage velocity of the current recording pass (S13: NO), the controller 100 determines as to whether or not the carriage velocity of the next recording pass is slower than the carriage velocity of the current recording pass (S16). Namely, the controller 100 determines as to whether or not the carriage velocity of the current recording is the normal velocity and that the carriage velocity of the next recording pass is the low velocity. Then, in a case that the controller 100 determines that the carriage velocity of the next recording pass is not slower than that of the current recording pass (that the carriage velocity of the current recording pass is equal to the carriage velocity of the next recording pass) (S16: NO), the controller 100 proceeds to a processing of S19. On the other hand, in a case that the controller 100 determines that the carriage velocity of the next recording pass is slower than that of the current recording pass (S16: YES), the controller 100 determines as to whether or not the ink discharging operation of the current recording pass is ended (S17). In a case that the controller 100 determines that the ink discharging operation is not ended (S17: NO), the controller 100 stands by until the discharging operation is ended.

Then, in a case that the controller 100 determines that the ink discharging operation is ended (S17: YES), the controller 100 causes the head-voltage generating circuit 97 to start a voltage boosting operation of performing boosting from the normal voltage to the high voltage (S18). Namely, by utilizing the period (time period) which is included in the current recording pass and during which the carriage 3 is decelerated, the controller 100 causes the head-voltage generating circuit 97 to perform the voltage boosting operation. In a case that the processing of S18 is ended, the controller 100 proceeds to a processing of S19.

In the processing of S19, the controller 100 determines as to whether or not the current recording pass is ended. Namely, the controller 100 determines as to whether or not the carriage 3 is stopped. In a case that the controller 100 determines that the current recording pass is not ended (S19: NO), the controller 100 stands by until the controller 100 determines that the current recording pass is ended. On the other hand, in a case that the controller 100 determines that the current recording pass is ended (S19: YES), the controller 100 controls the conveying motor 20 so as to convey the sheet P only by a predetermined distance in the conveyance direction (S20), and returns the procedure to the processing of S8 so as to execute the next recording pass.

In a case that the controller 100 determines, in the processing of S9, that the current recording pass is the last recording pass to be executed last in the case of performing recording of an image on one piece of the sheet P (S9: YES), the controller 100 determines as to whether or not the current recording pass is ended (S21). In a case that the controller 100 determines that the current recording pass is ended (S21: YES), the controller 100 executes a discharging processing of controlling the conveying motor 20 so as to discharge the sheet P having the image recorded thereon onto a non-illustrated paper discharge tray (S22). Afterwards, the controller 100 determines as to whether or not the recording of the image on the sheet P in accordance with the recording command is ended (S23). In a case that the controller 100 determines that the recording of the image is ended (S23: YES), the controller 100 returns the procedure to the processing of S1. On the other hand, in a case that the controller 100 determines that the recording of the image is not ended (S23: NO), the controller 100 returns the procedure to the processing of S2 to thereby execute the recording of the image on a next sheet P.

Figure 7:
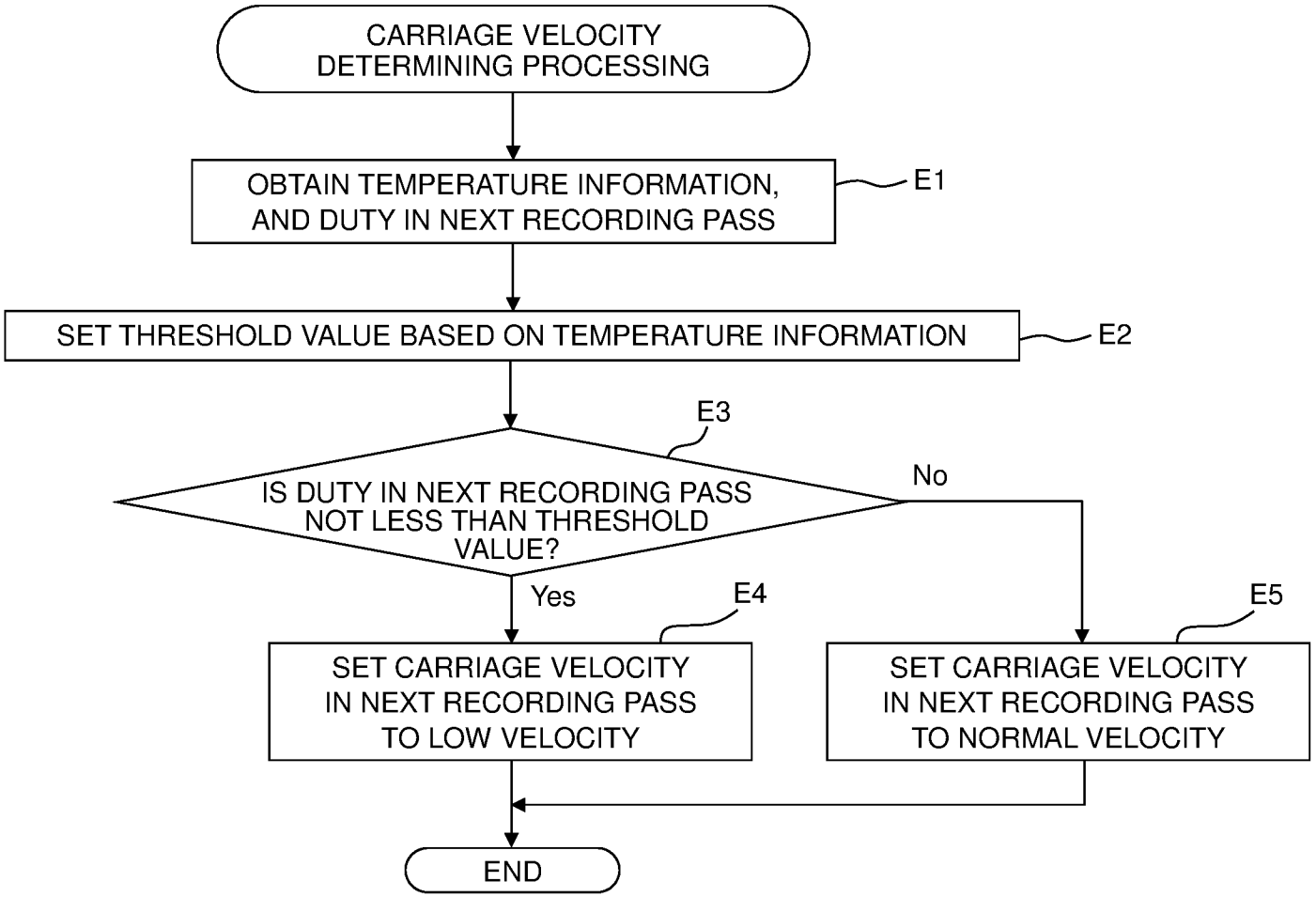
FIG. 7 is a flow chart depicting the flow of a carriage velocity determining processing.

Next, an explanation will be given about the carriage velocity determining processing, with reference to FIG. 7.

At first, the controller 100 obtains the temperature information from the temperature sensor 9, and calculates and obtains a duty in a case of executing of the next recording pass, based on the discharge data IM (E1). Next, the controller 100 sets the threshold value based on the temperature indicated by the obtained temperature information, and based on the threshold value setting table 104*a* (E2). Afterwards, the controller 100 determines as to whether or not the obtained duty is not less than the threshold value set in E2 (E3). In a case that the controller 100 determines that the duty is not less than the threshold value (E3: YES), the controller 100 sets the carriage velocity of the next recording pass to the low velocity (E4), and ends this processing. On the other hand, in a case that the controller 100 determines that the duty is less than the threshold value (E3: NO), the controller 100 sets the carriage velocity of the next recording pass to the normal velocity (E5), and ends this processing.

Figure 8A:
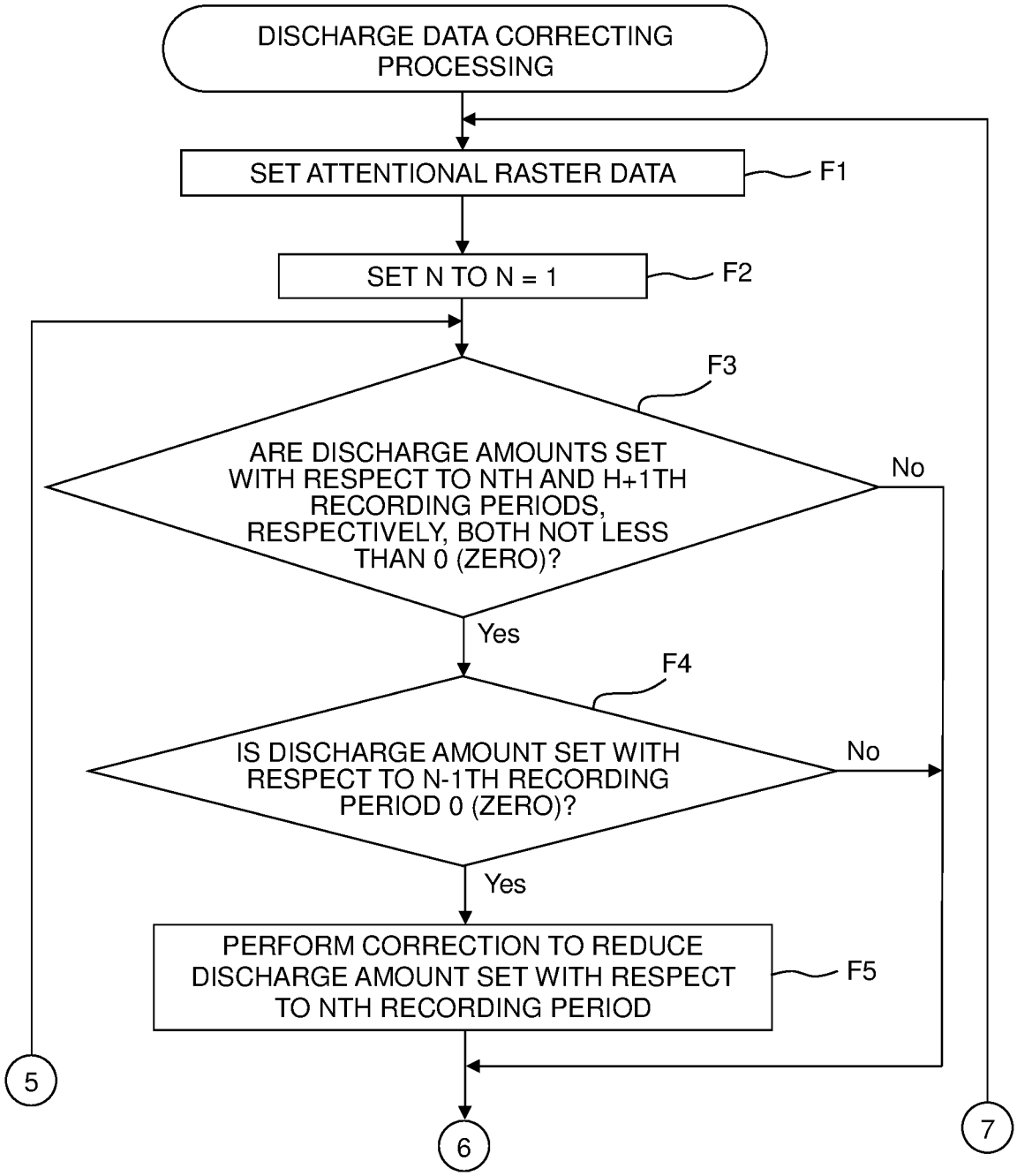
FIGS. 8A and 8B depict a flow chart depicting the flow of a discharge data correcting processing.
Figure 8B:
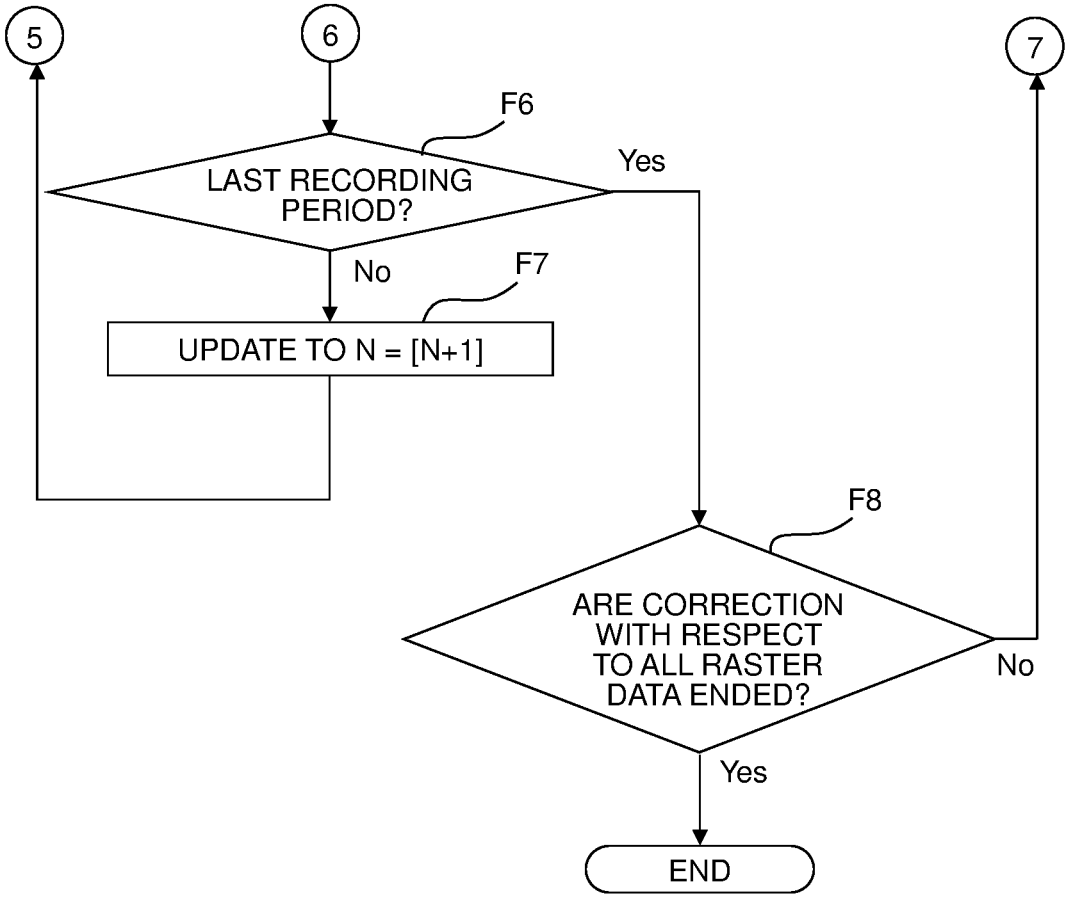

Next, an explanation will be given about the discharge data correcting processing, with reference to FIGS. 8A and 8B.

Firstly, the controller 100 sets one raster data L, of the discharge data IM, which corresponds the next recording pass to be an attentional raster data (F1). Next, the controller 100 sets a variable N to 1 (one). Afterwards, the controller 100 determines, in the attentional raster data, discharge amounts which are set with respect to a Nth unit recording period and a N+1th unit recording period, respectively, are both not less than 0 (zero) (F3). In a case that the controller 100 determines that the discharge amount which is set with respect to either one of the Nth unit recording period and the N+1th unit recording period is 0 (zero) (F3: NO), the controller 100 proceeds the procedure to the processing of F6.

On the other hand, in a case that the controller 100 determines that the discharge amounts set with respect to the Nth and N+1th unit recording periods, respectively, are not less than 0 (zero) (F3: YES), the controller 100 determines that the discharge amount set with respect to a N−1th unit recording period is 0 (zero) (F4). In a case that the controller 100 determines that the discharge amount set with respect to the N−1th unit recording period is not 0 (zero) (F4: NO), the controller 100 proceeds the procedure to the processing of F6. On the other hand, in case that the controller determines that the discharge amount set with respect to the N−1th unit recording period is 0 (zero) (F4: YES), the controller 100 executes such a correction that reduces the discharge amount set with respect to the Nth unit recording period (F5). In a case that the processing of F5 is ended, the controller 100 proceeds the procedure to the processing of F6.

In the processing of F6, the controller 100 determines as to whether or not the Nth unit recording period is the last unit recording period in the attentional raster data. Then, in a case that the controller 100 determines that the Nth unit recording period is not the last unit recording period (F6: NO), the controller 100 updates the variable N to [N+1] (F7), and returns the proceeding to the processing of F3. On the other hand, in a case that the controller 100 determines that the Nth unit recording period is the last unit recording period (F6: YES), the controller 100 determines as to whether or not the correction with respect to all the raster data L corresponding to the next recording pass is executed (F8). In a case that the controller 100 determines that the correction with respect to all the raster data L corresponding to the next recording pass is not executed (F8: NO), the controller 100 returns the procedure to the processing of F1 so as to set a new raster data to be the attentional raster data. On the other hand, in a case that the controller 100 determines that the correction with respect to all the raster data L corresponding to the next recording pass is executed (F8: YES), the controller 100 ends this processing.

According to the present embodiment as described above, in a case that the controller 100 executes a recording pass with the carriage velocity being made to be the low velocity, the controller 100 raises or boosts the voltage level of the driving signal, as compared with another case of executing a recording pass in which the carriage velocity is the normal velocity. In addition, in the case that the controller 100 executes the recording pass in which the carriage velocity is made to be the low velocity, the controller 100 changes the driving signal, which is to be output with respect to the first unit recording period in the recording period group, to be a driving signal in which the discharge amount is made to be smaller than the driving signal selected based on the discharge data IM stored in the RAM 103 before the execution of the discharge data correcting processing. By doing so, the discharge amount of the liquid discharged from the nozzle 51 can be made substantially same, regardless of the carriage velocity. As a result, it is possible to suppress any degradation in the quality of an image recorded on the sheet P.

In two recording passes which are continuous, the controller 100 determines, during execution of a preceding recording pass of the two continuous recording passes, as to whether the moving velocity of the carriage in a succeeding recording pass of the two continuous recording passes is made to be any one of the normal velocity and the low velocity, based on the duty according to the succeeding recording pass. With this, it is possible to shorten a processing time required for the recording processing, as compared with a configuration wherein the carriage velocity in the succeeding recording pass is determined after the completion of the preceding recording pass (after the carriage 3 is stopped).

Further, in a case that, in the two continuous recording passes, the carriage velocity in the preceding recording pass is the normal velocity and that the carriage velocity in the succeeding recording pass is the low velocity, the controller 100 causes the voltage generating circuit 97 to start the voltage boosting operation, during execution of the preceding recording pass at and after a point of time at which the discharge operation in the preceding recording pass has been ended. With this, it is possible to shorten a processing time required for the recording processing, as compared with a configuration wherein the voltage boosting operation is started after the completion of the preceding recording pass.

Similarly, in a case that, in the two continuous recording passes, the carriage velocity in the preceding recording pass is the low velocity and that the carriage velocity in the succeeding recording pass is the normal velocity, the controller 100 causes the voltage generating circuit 97 to start the voltage lowering operation, during execution of the preceding recording pass at and after a point of time at which the discharge operation in the preceding recording pass has been ended. With this, it is possible to shorten a processing time required for the recording processing, as compared with a configuration wherein the voltage lowering operation is started after the completion of the preceding recording pass.

In the foregoing, the embodiment of the present disclosure has been explained. The present disclosure, however, is not limited to or restricted by the above-described embodiment, and a various kinds of change may be made to the present disclosure, within the range described in the claims. For example, in the above-described embodiment, the image recording apparatus is an ink-jet printer of the serial system wherein the head 50 is moved to thereby move the head 50 relative to the sheet P; the image recording apparatus may be an ink-jet printer of the line system wherein the sheet P is moved to thereby move the head 50 relative to the sheet P, as in a modification depicted in FIG. 9. The modification will be specifically explained in the following. Note that in the following, a part or portion similar to that in the first embodiment as described above is assigned with a same reference numeral and any explanation therefor or illustration thereof in the drawing will be simplified or omitted, as appropriate.

Figure 9:
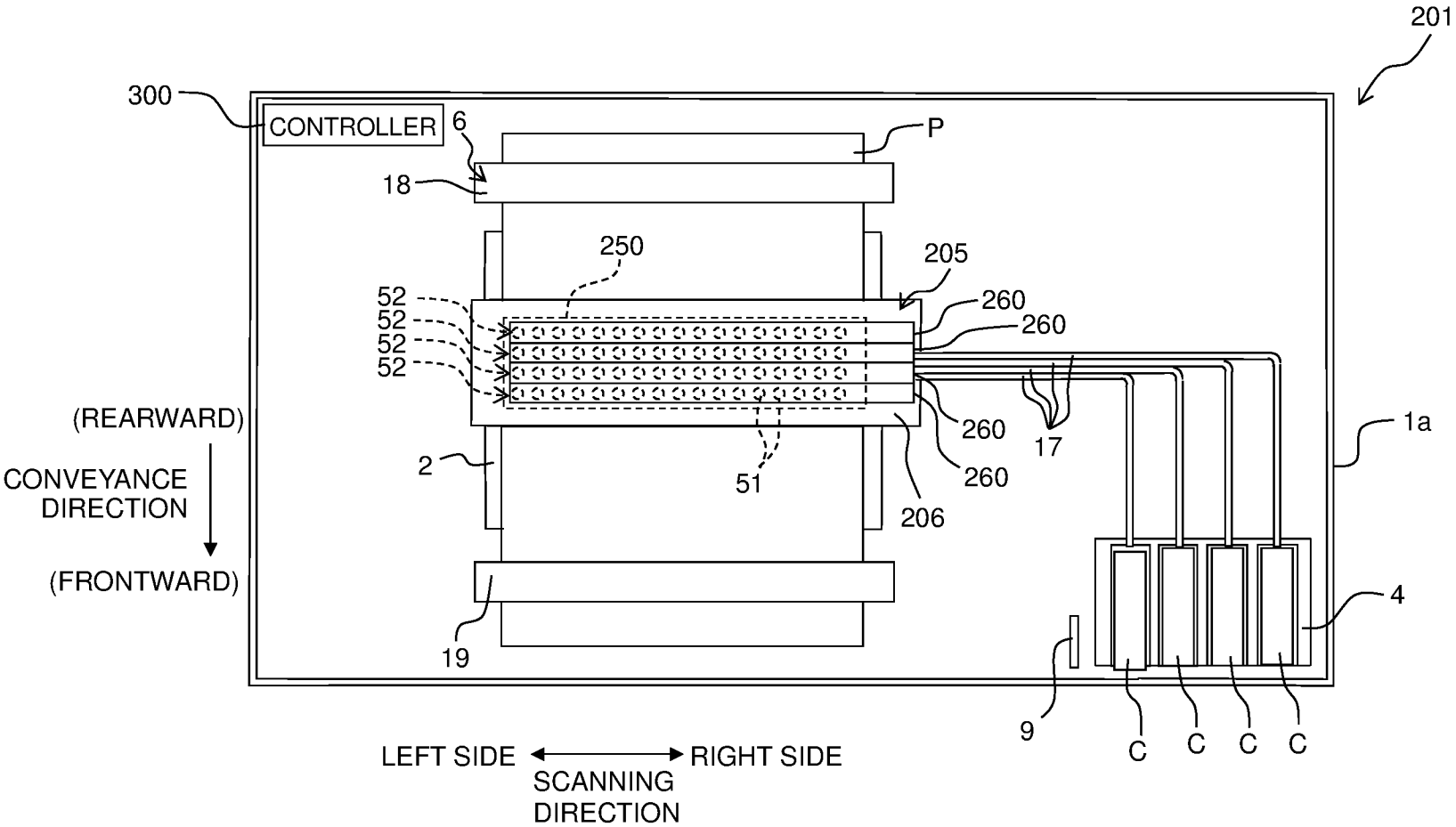
FIG. 9 is a schematic plan view of an ink-jet printer according to a modification.

A printer 201 of the modification depicted in FIG. 9 is provided with a platen 2, a conveying mechanism 6, a head unit 205, a temperature sensor 9, a head-voltage generating circuit 97, a controller 300, etc.

The head unit 205 is supported by a head unit supporting member 206 which is a plate-like member elongated in the scanning direction. The head unit 205 is provided with a head 250 and buffer tanks 206. The head 250 has a configuration which is substantially same as that of the above-described head 50, except that the number of the nozzle 51 is different from that of the head 50 and that four nozzle arrays 52 are aligned along the scanning direction. Therefore, any further explanation regarding the head 250 will be omitted. Further, since the buffer tanks 206 each have a configuration which is substantially same as that of the above-described buffer tanks 60, except that the shape is different from that of the buffer tanks 60, any further explanation regarding the buffer tanks 206 will be omitted.

In the recording processing, the controller 300 records an image on one piece of the sheet P by causing the ink to be discharged from the nozzles 51 of the head 250, while causing the conveying mechanism 6 to convey a sheet P in the conveyance direction. Specifically, in the recording processing, the controller 300 outputs a driving signal having a predetermined voltage level to each of the plurality of individual electrodes 89 of the piezoelectric actuator 86, at each of a plurality of pieces of unit recording period which are temporarily continuous, with a time required for the sheet P to move only by a unit distance corresponding to the resolution in the conveyance direction of an image to be recorded on the sheet P being defined as the unit recording period. In the present modification, the conveying mechanism 6 corresponds to the "moving mechanism" of the present disclosure.

Also in the printer 201 according to the present modification, in a case that the duty in recording one piece of image is large, any short supply of the ink to the head 250 might occur. In view of such a situation, in a case that one piece of image is to be recorded, the controller 300 causes the conveying mechanism 6 to convey the sheet P at any one of conveying velocities which are a first conveying velocity (corresponding to a "first velocity" of the present disclosure) and a second conveying velocity which is slower than the first conveying velocity (corresponding to a "second velocity" of the present disclosure). Specifically, before the controller 300 records an image on one piece of the sheet P, the controller 300 calculates and obtains a duty in a case of recording the image on one piece of the sheet P. In a case that the obtained duty is less than a predetermined threshold value, the controller 100 determines that there is no fear that the short supply of the ink might occur, and determines the carriage velocity to be the first conveying velocity. On the other hand, in a case that the obtained duty is not less than the predetermined threshold value, the controller 300 determines that there is a fear that the short supply of the ink might occur, and determines the carriage velocity to be the second conveying velocity.

As described above, by adjusting the conveying velocity of the sheet P in accordance with the duty in the case of recording an image on one piece of the sheet P, it is possible to reduce the possibility that the short supply of the ink to the head 250 might occur. Note that in the present modification, since the conveying velocity in the case of recording an image on one piece of the sheet P is constant, any unevenness in the concentration hardly occurs in the image recorded on the one piece of the sheet P. However, in the recording processing, any difference in hue (tint, color), etc., might occur between the image recorded on a sheet P conveyed at the first conveying velocity and the image recorded on a sheet P conveyed at the second conveying velocity.

In view of this situation, in a case that the controller 300 conveys a sheet P at the first conveying velocity, the controller 300 causes the head-voltage generating circuit 97 to generate the normal voltage. By doing so, the voltage level of the driving signal is made to be the first voltage level V1. On the other hand, in a case that the controller 300 conveys another sheet P at the second conveying velocity, the controller 300 causes the head-voltage generating circuit 97 to generate the high voltage. By doing so, the voltage level of the driving signal is made to be the second voltage level V2.

As described above, according to the present modification, the voltage level of the driving signal in a case of conveying the sheet P at the second conveying velocity is made to be higher than in a case of conveying the sheet P at the first conveying velocity. With this, it is possible to make the discharge amount (of the ink) to be discharged from the nozzle 51 to be substantially same, regardless of the conveying velocity of the sheet P. As a result, it is possible suppress any degradation in the quality of an image recorded on the sheet P.

Note that also in the present modification, in a case that, similarly to the above-described embodiment, the sheet P is conveyed at the second conveying velocity and that the recording period group including unit recording periods, among the plurality of pieces of unit recording period, which are continuous and in each of which the discharge amount based on the discharge data IM is greater than 0 (zero) is present, it is allowable to change the driving signal, which is to be output to the piezoelectric element 95 at a first unit recording period of the unit recording periods, among the plurality of pieces of the unit recording period, which are continuous in the recording period group, to the driving signal in which the discharge amount is made to be smaller than the driving signal set based on the discharge data IM.

In the following, other modifications will be explained.

In the above-described embodiment, in a case of recording an image on one piece of the sheet P, the duty is obtained with respect to each of the recording passes, immediately before starting each of the recording passes; it is allowable, however, to obtain the duties for all the recording passes before starting the first recording pass. In such a case, it is allowable to determine the carriage velocities with respect to all the recording passes, respectively, before executing the first recording pass. Further, in two recording passes which are continuous, it is allowable that the carriage velocity in a succeeding recording pass of the two continuous recording passes is determined after the completion of a preceding recording pass of the two continuous recording passes (after the carriage 3 is stopped).

Furthermore, it is allowable to provide a configuration wherein the discharge data correcting processing is not executed. Namely, in a case of executing the recording pass with the carriage velocity being made to be the low velocity, it is allowable that the controller does not change the driving signal, which is to be output with respect to the first unit recording period in the recording period group, to be a driving signal in which the discharge amount is made to be smaller than the driving signal selected based on the discharge data IM stored in the RAM 103. Moreover, in the above-described embodiment, the discharge data IM is corrected to thereby change the driving signal. The present disclosure, however, is not limited to or restricted by this. For example, it is allowable that the controller 100 analyzes the discharge data IM, without correcting the discharge data IM; and that in a case of selecting a driving signal, which is to be output with respect to the first unit recording period in the recording period group, the controller 100 selects a driving signal in which the discharge amount is smaller than the driving signal selected based on the discharge data IM.

Further, although the "information regarding a supply state of the liquid from the liquid tank to the head" corresponds to the information including two pieces of information which are the duty and the temperature information output from the temperature sensor 9, the present disclosure is not particularly limited to or restricted by this. For example, the "information regarding a supply state of the liquid from the liquid tank to the head" may correspond to information including either one of the duty and the temperature information output from the temperature sensor 9. Furthermore, as an accumulated amount of the ink passing through the filter FT provided on the ink supply port 85 is increased, an amount of any foreign matter which is trapped by the filter FT is increased, which in turn might results in such a possibility that the filter FT might be clogged. In a case that the filter FT is clogged, the channel resistance in the filter FT is increased, and thus any shortage in the supply of the ink to the head 50 might easily occur. Accordingly, information regarding a total supply amount of the ink supplied from the cartridge C to the head 50 may be obtained as the "information regarding a supply state of the liquid from the liquid tank to the head". In such a case, for example, it is allowable to set the threshold value, which is to be compared with the duty, to be smaller as the total supply amount of the ink supplied from the cartridge C to the head 50 is greater. The information regarding the total supply amount of the ink supplied from the cartridge C to the head 50 may be an actual total amount of the ink supplied from the cartridge C to the head 50, or may be a number of times of exchange of the ink cartridge C.

Moreover, in the above-described embodiment, the carriage velocity is adjusted based on the "information regarding a supply state of the liquid from the liquid tank to the head", the present disclosure is not particularly limited to or restricted by this. For example, in a case that a normal recording mode and a high quality recording mode in which the quality of image is higher than the normal recording mode are provided as the recording mode of the recording processing, it is allowable to change the carriage velocity in accordance with the recording mode selected by a recording command, etc. Specifically, it is allowable to determine the carriage velocity to be the normal velocity in a case that the normal recording mode is selected, and to determine the carriage velocity to be the low velocity in a case that the high quality recording mode is selected.

Further, it is allowable that a plurality of steps of carriage velocities are set in advance in accordance with the resolution in the scanning direction of an image to be recorded on the paper sheet, etc., and that any one of the plurality of steps of carriage velocities is selected, based on the recording command, as a default carriage velocity in a case of executing the recording pass. Further, the default carriage velocity is determined as a carriage velocity of a recording pass in which there is no fear that any supply shortage of the ink to the head might occur (for example, a recording pass in which the duty is less than the threshold value). On the other hand, it is allowable to determine any one of the plurality of steps of carriage velocities, which is slower than the default carriage velocity, is determined as a carriage velocity of a recording pass in which there is a fear that any supply shortage of the ink to the head might occur (for example, a recording pass in which the duty is not less than the threshold value). Furthermore, it is allowable that the carriage velocity is configured to be changeable or variable to a desired velocity. In such a case, for example, it is allowable that the carriage velocity of a recording pass in which there is a fear that any supply shortage of the ink to the head might occur is determined to be an arbitrary carriage velocity which is different from the plurality of steps of carriage velocities.

Moreover, in the above-described embodiment, the carriage velocity is configured to be adjustable in the two steps between the normal velocity and the low velocity. However, it is allowable that the carriage velocity is configured to be adjustable finely in not less than three steps. In accordance with this, it is allowable that the voltage level of the driving signal is also configured to be adjustable finely in not less than three steps. Further, in the above-described embodiment, although each of the values of the first and second voltage levels is set in advance at the time of shipment from a factory, etc., it is allowable that the controller sets each of the values of the first and second voltage levels based on the carriage velocity at a time of execution of the recording pass. For example, under a condition that the voltage level of the driving signal for executing a recording pass by moving the carriage at the default carriage velocity is the first voltage level, in a case that the controller executes a recording pass by moving the carriage at an arbitrary carriage velocity which is slower than the default carriage velocity, the controller may calculate and set the second voltage level based on the default carriage velocity, the arbitrary carriage velocity and the first voltage level.

In a case that, in the two continuous recording passes, the carriage velocity in the preceding recording pass is the normal velocity and that the carriage velocity in the succeeding recording pass is the low velocity, the controller may start the voltage boosting operation after the preceding recording pass is ended. Similarly, in a case that, in the two continuous recording passes, the carriage velocity in the preceding recording pass is the low velocity and that the carriage velocity in the succeeding recording pass is the normal velocity, the controller may starts the voltage lowering operation after the preceding recording pass is ended.

Further, in the above-described embodiment, the voltage level of the driving signal is adjusted by adjusting the driving voltage generated by the head-voltage generating circuit 97, the present disclosure is not limited to or restricted by this embodiment. For example, in a case that the driver IC has a circuit capable of adjusting the voltage level of the driving signal, it is allowable that the voltage level of the driving signal is adjusted by this circuit. In the above-described embodiment, the driver IC 90 is separated from the controller 100. In this case, it is possible to consider that the combination of the controller 100 and the driver IC 90 substantially serves as a controller. Further, the present disclosure is not limited to or restricted by this embodiment. For example, the driver IC 90 can be incorporated in the controller 100.

The driving system of the piezoelectric actuator 86 is not limited to the "pull driving system", and may be a "push driving system" (a system wherein each of the individual electrodes 86 is maintained in advance at the ground potential, and in a case that a driving pulse is applied, the volume in the inside of the pressure chamber 83 is reduced to thereby cause the liquid to be discharged from the nozzle 51). Furthermore, the driving element is not limited to the piezoelectric element; it is allowable, for example, to adopt a heating member (heat generating body) which is configured to heat the ink so as to generate film boiling.

Moreover, although the foregoing explanation has been made regarding the example wherein the present disclosure is applied to a printer which discharges ink(s) from the nozzles onto the paper sheet to thereby record an image on the paper sheet, the present disclosure is not limited to this. It is allowable to apply the present disclosure to an image recording apparatus configured to discharge a liquid onto a recording medium which is different from the sheet P, to thereby perform recording of an image on the recording medium. The present disclosure is applicable also to a printer which is capable of moving a stage having a recording medium placed thereon in the conveyance direction and which is configured to perform recording on the recording medium by alternately repeating an operation of discharging the ink from the nozzles while moving a head together with a carriage in the scanning direction (recording pass) and an operation of moving the stage, as described for example in Japanese Patent Application Laid-open No. 2017-144726. The disclosure of Japanese Patent Application Laid-open No. 2017-144726 is incorporated herein by reference in its entirety. The recording medium usable in such a printer includes, for example, a T-shirt, a sheet for outdoor advertisement, etc. Further, the present disclosure is applicable also to an image recording apparatus which discharges or jets a liquid different from the ink, for example, a material for wiring pattern, etc., onto a wiring substrate, so as to perform recording of an image. Furthermore, the present disclosure is applicable also to an image recording apparatus which discharges an ink onto a case for a mobile terminal (portable terminal) such as smartphone, etc., a corrugated cardboard box, a resin, etc.

What is claimed is:

1. An image recording apparatus comprising:

a head to which a liquid is supplied from a liquid tank via a supply path, the head including an internal channel having a nozzle, and a driving element configured to impart, to the liquid in the internal channel, discharge energy for discharging the liquid from the nozzle;

a moving mechanism configured to move, in a relative moving direction, one of a medium and the head relative to the other of the medium and the head; and a controller configured to output, to the driving element, a driving signal having a first voltage level or a second voltage level greater than the first voltage level, and to execute recording of an image on the medium by controlling the head to discharge the liquid from the nozzle toward the medium, while controlling the moving mechanism to move the head relative to the medium, wherein in a case that the controller executes the recording on the medium by controlling the head, the controller is configured to:

generate the driving signal and output the driving signal to the driving element, at each of a plurality of pieces of a unit recording period which are continuous, with a time required for relative movement of one of the medium and the head relative to the other of the medium and the head only by a unit distance corresponding to resolution in the relative moving direction of an image to be recorded on the medium being defined as the unit recording period;

control the moving mechanism to move the head relative to the medium selectively at either one of a first velocity and a second velocity slower than the first velocity;

allow a voltage level of the driving signal to be the first voltage level in a case that the controller causes the head to move relative to the medium at the first velocity; and allow the voltage level of the driving signal to be the second voltage level in a case that the controller causes the head to move relative to the medium at the second velocity.

2. The image recording apparatus according to claim 1, wherein the driving signal is a pulse signal, a pulse-width of the driving signal having the first voltage level is same as a pulse-width of the driving signal having the second voltage level, and a number of pulses in the unit recording period of the driving signal having the first voltage level is same as a number of pulses in the unit recording period of the driving signal having the first voltage level.

3. The image recording apparatus according to claim 1, further comprising a memory configured to store discharge data in which a discharge amount of the liquid to be discharged from the nozzle is set with respect to each of the plurality of pieces of the unit recording period which are continuous, wherein the controller is configured to:

select, with respect to each of the plurality of pieces of the unit recording period which are continuous, a driving signal among a plurality of types of the driving signal, which are mutually different in the discharge amount of the liquid to be discharged from the nozzle, based on the discharge data, output the selected driving signal to the driving element, and wherein under a condition that a recording period group including unit recording periods, among the plurality of pieces of the unit recording period, which are continuous and in each of which the discharge amount set based on the discharge data is greater than zero is present in the case that the controller causes the head to move relative to the medium at the second velocity, the controller is configured to change the driving signal, which is to be output to the driving element at a first unit recording period among the unit recording periods in the recording period group, to the driving signal in which the discharge amount is made to be smaller than the discharge amount in the driving signal set based on the discharge data.

4. The image recording apparatus according to claim 1, wherein the moving mechanism is a carriage configured to mount the head and configured to move in a scanning direction, the controller is configured to execute a plurality of recording passes to record the image on one piece of the medium, each of the plurality of recording passes being a processing of outputting the driving signal to the driving element at one of the plurality of pieces of the unit recording period which are continuous so as to discharge the liquid from the nozzle, while controlling the carriage to move the carriage, and the controller is configured to move the carriage, at each of the plurality of recording passes, selectively at either one of the first velocity and the second velocity.

5. The image recording apparatus according to claim 4, wherein in a case that the controller executes the recording of the image on the one piece of the medium by executing the plurality of recording passes, the controller is configured to obtain information regarding a supply state of the liquid supplied from the liquid tank to the head in a case of executing each of the plurality of recording passes, before the controller executes each of the plurality of recording passes; and the controller is configured to determine as to whether a moving velocity of the carriage in each of the plurality of recording passes is made to be the first velocity or the second velocity, based on the obtained information regarding the supply state.

6. The image recording apparatus according to claim 5, wherein the information regarding the supply state includes information regarding a liquid discharge amount of the liquid to be discharged from the head in the case of executing each of the plurality of recording passes.

7. The image recording apparatus according to claim 6, wherein the information regarding the liquid discharge amount includes a duty which is a ratio of a discharge amount of the liquid from the nozzle to a maximum discharge amount of the liquid from the nozzle, the maximum discharge amount being an amount of the liquid discharged from all the plurality of nozzles in a certain recording pass included in the plurality of recording passes.

8. The image recording apparatus according to claim 5, wherein in two continuous recording passes included in the plurality of recording passes, the controller is configured to determine, during execution of a preceding recording pass of the two continuous recording passes, whether the moving velocity of the carriage in a succeeding recording pass of the two continuous recording passes is the first velocity or the second velocity, based on the information regarding the supply state regarding the succeeding recording pass.

9. The image recording apparatus according to claim 5, further comprising a power source capable of selectively generating a first driving voltage and a second driving voltage higher than the first driving voltage to be applied to the driving element, wherein in a case that the controller generates the driving signal having the first voltage level, the controller is configured to cause the power source to generate the first driving voltage, in a case that the controller generates the driving signal having the second voltage level, the controller is configured to cause the power source to generate the second driving voltage, and in a case that, in two continuous recording passes included in the plurality of recording passes, the controller causes the carriage to move at the first velocity in a preceding recording pass of the two continuous recording passes and causes the carriage to move at the second velocity in a succeeding recording pass of the two continuous recording passes, the controller is configured to cause the power source to start a voltage boosting operation, of performing boosting from the first driving voltage to the second driving voltage, during execution of the preceding recording pass at and after a point of time at which discharge of the liquid from the nozzle in the preceding recording pass has ended.

10. The image recording apparatus according to claim 5, further comprising a power source capable of selectively generating a first driving voltage and a second driving voltage higher than the first driving voltage to be applied to the driving element, wherein in a case that the controller generates the driving signal having the first voltage level, the controller is configured to cause the power source to generate the first driving voltage, in a case that the controller generates the driving signal having the second voltage level, the controller is configured to cause the power source to generate the second driving voltage, and in a case that, in two continuous recording passes included in the plurality of recording passes, the controller causes the carriage to move at the second velocity in a preceding recording pass of the two continuous recording passes and causes the carriage to move at the first velocity in a succeeding recording pass of the two continuous recording passes, the controller is configured to cause the power source to start a voltage lowering operation of performing lowering from the second driving voltage to the first driving voltage during execution of the preceding recording pass at and after a point of time at which discharge of the liquid from the nozzle in the preceding recording pass has ended.

11. The image recording apparatus according to claim 1, wherein the controller is configured to obtain information regarding a supply state of the liquid supplied from the liquid tank to the head, before the controller executes the recording of the image on the medium, and in the case that the controller executes the recording of the image on the medium, the controller is configured to determine as to move the head relative to the medium at which one of the first velocity and the second velocity, based on the obtained information regarding the supply state.

12. The image recording apparatus according to claim 11, further comprising a temperature sensor, wherein the information regarding the supply state includes temperature information regarding a temperature measured by the temperature sensor.

13. The image recording apparatus according to claim 11, wherein a filter is provided on the supply path, and the information regarding the supply state includes a total supply amount of the liquid supplied from the liquid tank to the head while passing through the filter provided on the supply path.

14. The image recording apparatus according to claim 11, further comprising:

a filter provided on the supply path; and a tank installing part configured to detachably install the liquid tank, wherein the information regarding the supply state includes a number of times the liquid tank is exchanged.

* * * * *